US009429387B1

(12) United States Patent
Barfoot et al.

(10) Patent No.: US 9,429,387 B1
(45) Date of Patent: Aug. 30, 2016

(54) MODULAR STOCK FOR A FIREARM

(71) Applicant: Magpul Industries Corp., Louisville, CO (US)

(72) Inventors: Grady Barfoot, Denver, CO (US); Turner Sessions, Lafayette, CO (US); William Bradley Bennett, Lafayette, CO (US); Duane Liptak, Erie, CO (US); Michael T. Mayberry, Denver, CO (US)

(73) Assignee: MAGPUL INDUSTRIES CORP., Austin, TX (US)

( * ) Notice: Subject to any disclaimer, the term of this patent is extended or adjusted under 35 U.S.C. 154(b) by 0 days.

(21) Appl. No.: 15/076,499

(22) Filed: Mar. 21, 2016

Related U.S. Application Data

(63) Continuation-in-part of application No. 14/664,229, filed on Mar. 20, 2015, now Pat. No. 9,322,611.

(51) Int. Cl.

| | |
|---|---|
| ***F41C 23/00*** | (2006.01) |
| ***F41C 23/16*** | (2006.01) |
| ***F41A 21/48*** | (2006.01) |
| ***F41C 23/20*** | (2006.01) |

(52) U.S. Cl.
CPC ..... *F41C 23/16* (2013.01); *F41A 21/48* (2013.01); *F41C 23/20* (2013.01)

(58) Field of Classification Search
USPC ..... 42/71.01, 73, 75.01, 72, 77
See application file for complete search history.

(56) References Cited

U.S. PATENT DOCUMENTS

| | | | | |
|---|---|---|---|---|
| 1,370,118 | A | 3/1921 | Johnson | |
| 1,760,731 | A | 5/1930 | Williams | |
| 2,529,733 | A | 11/1950 | King | |
| 3,611,611 | A | 10/1971 | Quinney | |
| 3,842,527 | A | 10/1974 | Low | |
| 4,220,071 | A | 9/1980 | Seiderman | |
| 4,297,801 | A | 11/1981 | Kahn | |
| 4,519,156 | A | 5/1985 | Shaw | |
| 4,608,909 | A | 9/1986 | Peters | |
| 4,644,930 | A * | 2/1987 | Mainhardt | F41A 11/02 124/58 |
| 4,864,761 | A | 9/1989 | Gregory | |

(Continued)

FOREIGN PATENT DOCUMENTS

| | | |
|---|---|---|
| EP | 2661599 A1 | 11/2013 |
| EP | 2791611 A1 | 10/2014 |

(Continued)

OTHER PUBLICATIONS

Krynski, William, International Search Report and Written Opinion re Application No. PCT/US16/18744, Apr. 21, 2016, p. 10, Published in: WO.

(Continued)

*Primary Examiner* — J. Woodrow Eldred
(74) *Attorney, Agent, or Firm* — Neugeboren O'Dowd PC

(57) ABSTRACT

This disclosure describes systems, methods, and apparatus for a selectable barrel support that can be inserted into a forend of a firearm stock to support a first barrel type and flipped, rotated, or otherwise moved to support a second barrel type (or third or fourth barrel types). A tensioning mechanism is provided. Bull and tapered barrels are examples of two barrel types that the selectable barrel support can be used to support. The selectable barrel support enables a firearm owner or gunsmith to exchange barrel types on a firearm without having to switch out the firearm stock.

20 Claims, 28 Drawing Sheets

(56) References Cited

U.S. PATENT DOCUMENTS

| | | | | |
|---|---|---|---|---|
| 4,989,359 | A | 2/1991 | Kinkner et al. | |
| 5,228,887 | A | 7/1993 | Mayer | |
| 5,410,834 | A | 5/1995 | Benton et al. | |
| 5,423,145 | A | 6/1995 | Nasset | |
| 5,540,008 | A | 7/1996 | Kirnstatter | |
| 5,544,564 | A | 8/1996 | Balbo et al. | |
| 5,678,343 | A | 10/1997 | Menges et al. | |
| 5,706,599 | A | 1/1998 | Knight | |
| 5,987,797 | A | 11/1999 | Dustin | |
| 6,205,696 | B1 | 3/2001 | Bilgeri | |
| 6,223,458 | B1 | 5/2001 | Schwinkendorf et al. | |
| 6,301,817 | B1 * | 10/2001 | Hogue | F41C 23/18 42/71.01 |
| 6,427,372 | B1 | 8/2002 | Howard et al. | |
| 6,637,142 | B1 | 10/2003 | Reynolds | |
| 6,889,462 | B1 | 5/2005 | Carlson | |
| 7,104,000 | B2 | 9/2006 | Orth | |
| 7,137,219 | B2 | 11/2006 | Wossner et al. | |
| 7,451,564 | B2 | 11/2008 | Wait | |
| 7,523,579 | B2 | 4/2009 | Al-Mulla | |
| 7,587,853 | B2 | 9/2009 | Aalto | |
| 7,631,453 | B2 | 12/2009 | Longueira | |
| 7,823,314 | B1 | 11/2010 | Wheatley | |
| 7,841,121 | B1 | 11/2010 | Barrett | |
| 8,056,278 | B2 | 11/2011 | Bentley | |
| 8,079,169 | B2 | 12/2011 | Gregg | |
| 8,176,671 | B2 | 5/2012 | Pfersman et al. | |
| 8,220,194 | B2 | 7/2012 | Crow | |
| 8,230,632 | B2 | 7/2012 | Moretti | |
| 8,230,633 | B1 | 7/2012 | Sisk | |
| 8,234,808 | B2 | 8/2012 | Lewis et al. | |
| 8,341,863 | B2 | 1/2013 | Kefer | |
| 8,397,415 | B2 | 3/2013 | Laney et al. | |
| 8,397,416 | B2 | 3/2013 | Laney et al. | |
| 8,464,628 | B2 | 6/2013 | Potterfield et al. | |
| 8,522,468 | B2 | 9/2013 | Webber et al. | |
| 8,539,708 | B2 | 9/2013 | Kenney et al. | |
| 8,713,838 | B2 | 5/2014 | Ubl et al. | |
| 8,714,144 | B2 | 5/2014 | Zadra | |
| 8,782,940 | B1 | 7/2014 | Morris | |
| 8,782,943 | B2 | 7/2014 | Jarboe | |
| 8,806,789 | B2 | 8/2014 | Devine | |
| 8,832,987 | B2 | 9/2014 | Addis | |
| 8,881,444 | B2 | 11/2014 | Warburton et al. | |
| 8,904,692 | B2 | 12/2014 | Ballard | |
| 8,931,200 | B2 | 1/2015 | Pratt | |
| 8,931,393 | B1 | 1/2015 | Vincent et al. | |
| 8,935,872 | B2 | 1/2015 | Zukowski | |
| 8,984,790 | B2 | 3/2015 | Wilson et al. | |
| 9,074,839 | B2 | 7/2015 | Warburton | |
| 9,091,505 | B1 | 7/2015 | Battaglia | |
| 9,140,506 | B2 | 9/2015 | Gomez | |
| 9,151,553 | B2 | 10/2015 | Constant et al. | |
| D744,055 | S | 11/2015 | Bitz | |
| D745,623 | S | 12/2015 | Flores | |
| D745,940 | S | 12/2015 | Flores | |
| 9,234,717 | B2 | 1/2016 | Jarboe | |
| 9,267,750 | B1 | 2/2016 | Tubb | |
| 9,273,929 | B2 | 3/2016 | Sugg | |
| 9,322,611 | B1 * | 4/2016 | Barfoot | F41C 23/16 |
| 2006/0162217 | A1 | 7/2006 | Longueira | |
| 2007/0271833 | A1 | 11/2007 | Fletcher | |
| 2014/0026460 | A1 | 1/2014 | Warburton et al. | |
| 2014/0190057 | A1 | 7/2014 | Simpson | |
| 2015/0000171 | A1 | 1/2015 | Roberts | |
| 2015/0007475 | A1 | 1/2015 | Hasler | |
| 2015/0107144 | A1 | 4/2015 | DiChario | |
| 2015/0192384 | A1 | 7/2015 | Ballard | |
| 2015/0247695 | A1 | 9/2015 | Jarboe | |
| 2015/0377575 | A1 | 12/2015 | Potter et al. | |
| 2015/0377584 | A1 | 12/2015 | Chvala | |
| 2016/0003576 | A1 | 1/2016 | Spykerman et al. | |
| 2016/0047623 | A1 * | 2/2016 | Frankel | F41C 23/00 42/71.01 |

FOREIGN PATENT DOCUMENTS

| | | | |
|---|---|---|---|
| EP | 2828604 | A1 | 1/2015 |
| ES | 2548151 | T3 | 10/2015 |
| GB | 2485166 | A | 5/2012 |
| WO | 2015186017 | A1 | 12/2015 |
| WO | 2015200588 | A1 | 12/2015 |

OTHER PUBLICATIONS

Tacstar, "TacStar Ruger 10-22 Adaptive Tactical Stock", "Webpage found at www.tacstar.com/home/tacticalstock.php Inventor(s) aware of prior art on or before Jul. 6, 2015", p. 3, Published in: US.

Victor, Michael, "Victor Company Titan 1022 Forum", Website located at http://www.rimfirecentral.com/forums/showpost.php?p=5128423&postcount=157, Published on Sep. 8, 2014, Known to inventors as early as Nov. 12, 2015, p. 1.

Rwal, "Spring Loaded Barrel Support", Website located at http://www.rimfirecentral.com/forums/showthread.php?t=92703, Published on Apr. 22, 2005, Known to inventors as early as Nov. 12, 2015, p. 4.

Stockys, LLC, "Stocky's New Long Range Composite Stock—Remington 700—Textured Finish", Website located at https://www.stockysstocks.com/stocky-s-new-long-range-composite-stock-remington-700-painted.html, Known to inventors as early as Jan. 22, 2016, p. 3.

Lyman Products, "TacStar—Adaptive Tactical 10-22 Stock", Website located at https://www.youtube.com/watch?v=ZfNOzG6FGRg, Published on Sep. 30, 2013, p. 4.

Midway USA, "TacStar Stock M4 Tactical Collapsible Ruger 10/22 Synthetic", Website located at http://www.midwayusa.com/product/1535931703/tacstar-stock-m4-tactical-collapsible-ruger-10-22-synthetic, Published on Oct. 25, 2013, p. 1.

* cited by examiner

MODULAR STOCK FOR A FIREARM

CROSS-REFERENCE TO RELATED APPLICATIONS

This application is a continuation-in-part of U.S. patent application Ser. No. 14/664,229, filed Mar. 20, 2015 and entitled "MODULAR STOCK FOR A FIREARM," the entire disclosure of which is hereby incorporated by reference for all proper purposes.

FIELD OF THE INVENTION

The present invention relates to firearms. In particular, but not by way of limitation, the present invention relates to systems and methods for firearm stocks.

BACKGROUND OF THE INVENTION

Rifles often can be fitted with two primary types of barrels: tapered or bull barrels (also known as target barrels or heavy barrels). The bull or target barrel typically has a non-tapered or cylindrical shape, whereas a tapered barrel (typically affixed to most firearms) is tapered toward the muzzle such that the diameter at the muzzle is less than a diameter at the receiver. The non-tapered nature of bull barrels means that they are steadier due to greater weight, less prone to vibration due to their geometry, and can absorb more thermal energy due to their greater mass of metal (and hence are less prone to warping under repeated firing), and are therefore preferred in some applications. Most firearm stocks are shaped to support either of these barrel types, but not both. This means that users who wish to switch barrel types must buy and install an entirely new stock when installing a new barrel. U.S. Pat. No. 8,056,278 to Bentley provides one solution to this problem in the form of a stock that supports a bull barrel and an insert that can be fitted into the stock to support a tapered barrel. Thus, the '278 patent enables a change in barrel types without the purchase and installation of an entirely new stock. However, this design suffers from the need to store and keep track of the insert when the stock is used with a bull barrel and hence without the insert.

One application where the switching of barrels occurs is the RUGER 10/22, a widespread .22 caliber rifle platform. The RUGER 10/22 includes a safety pin that is perpendicular to the barrel and arranged on the top front portion of the trigger guard just below the stock. When the trigger guard is inserted into the stock the safety pin must clear an opening in the bottom of the stock shaped to pass the trigger guard. However, the safety pin will impinge one or another side of this opening unless the safety pin is 'centered' in the trigger guard such that neither end of the safety pin extends beyond the sides of the trigger guard.

In other examples, it is known that less expensive or lighter rifles may be manufactured to looser tolerance standards, have excessive relative movement between the barrel and the stock, and/or have an undesirable amount of bending within the barrels themselves, any or all of which result in a less accurate weapon.

Moreover, it appears that manufacturers have recognized this as a problem as well, given that factory 10/22 rifles are generally provided with a barrel band. The barrel band is a ring of material that slips over the end of the stock and the barrel, and, by design, mounts the barrel to the stock—that is, locks the parts together. However, the barrel band does not pull the stock and the barrel together in a manner that is finely adjustable, and therefore does not improve the accuracy of the weapon.

There therefore remains a need for a system or method of improving accuracy in lighter rifles and/or rifles manufactured to relatively loose tolerance standards and/or other new and innovative features.

SUMMARY

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

In one example, a firearm stock is provided. In this example, the stock has a forend, a buttstock coupled to the forend, a selectable barrel support, and a tensioning mechanism. The forend has a recess formed from first and second inner sides and an inside bottom of the forend. The selectable barrel support is seated in the recess in the forend and is configured to support a barrel of a firearm. The selectable barrel support has an elongate frame with a longitudinal axis, a first concave barrel recess shaped to support a first barrel type and positioned on a first side of the elongate frame, and a second concave barrel recess shaped to support a second barrel type and positioned on a second side of the elongate frame. The barrel tensioning mechanism has a first support frame and an adjustment mechanism. The adjustment mechanism is configured to be positioned between the first support frame and the selectable barrel support. The first support frame has a first position and a second position and is configured to move between and including the first and second positions. In the first position the first support frame is substantially flush with or recessed in the first concave barrel recess. In the second position the first support frame protrudes into the first concave barrel recess.

In another example, a barrel support system for a firearm stock is provided. In this example, the barrel support system has a selectable barrel support, and a first barrel tensioning mechanism. The selectable barrel support has an elongate frame with a longitudinal axis, a first concave barrel recess shaped to support a first barrel type positioned on a first side of the elongate frame, and a second concave barrel recess shaped to support a second barrel type on a second side of the elongate frame. The first barrel tensioning mechanism has a first support frame and an adjustment mechanism. The adjustment mechanism is configured to be positioned between the first support frame and the selectable barrel support. The first support frame has a first position and a second position and is configured to move between and including the first and second positions. In the first position, the first support frame is substantially flush with or recessed in the first concave barrel recess. In the second position, the first support frame protrudes into the first concave barrel recess.

In another embodiment, a selectable barrel support kit is provided. In this example, the selectable barrel support kit has a selectable barrel support and a barrel tensioning mechanism. The selectable barrel support has an elongate frame with a longitudinal axis, a first concave barrel recess shaped to support a first barrel type positioned on a first side of the elongate frame, and a second concave barrel recess shaped to support a second barrel type on a second side of the elongate frame. The barrel tensioning mechanism has a first support frame, a second support frame, and an adjustment mechanism configured to adjust a seating position of at least one of the first support frame or the second support frame. The seating position is adjustable between a first position in which the at least one of the first support frame or the second support frame is flush with or recessed in the selectable barrel support, and a second position in which the at least one of the first support frame or the second support frame protrudes from the selectable barrel support.

BRIEF DESCRIPTION OF THE DRAWINGS

Various objects and advantages and a more complete understanding of the present invention are apparent and more readily appreciated by referring to the following detailed description and to the appended claims when taken in conjunction with the accompanying drawings:

DETAILED DESCRIPTION

This disclosure discusses a firearm stock including at least a selectable barrel support insert shaped to support at least two different barrel types or shapes, for instance either a tapered or bull barrel. In a particular embodiment, this discussion enables a bull barrel or barrel tapered toward a front of the barrel to be used in a firearm stock without requiring a change of the firearm stock.

Figure 1:
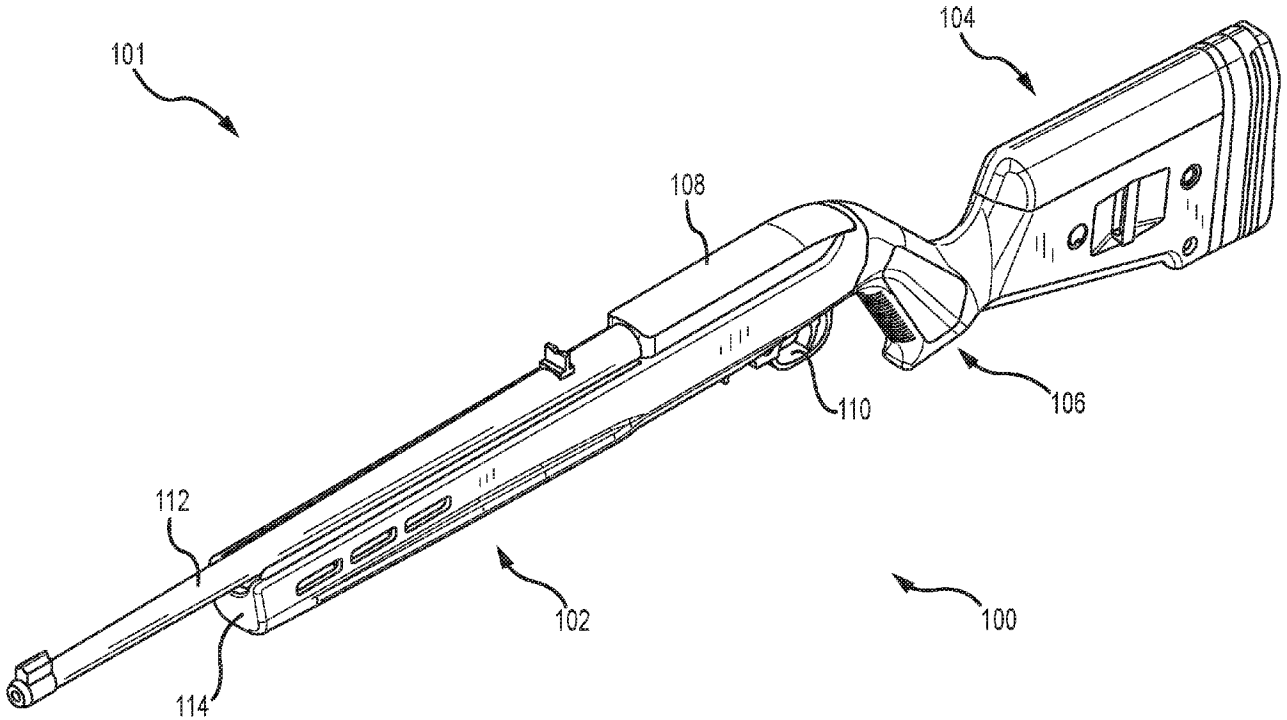
FIG. 1 shows a firearm stock including a selectable barrel support implemented in a complete firearm.
Figure 2:
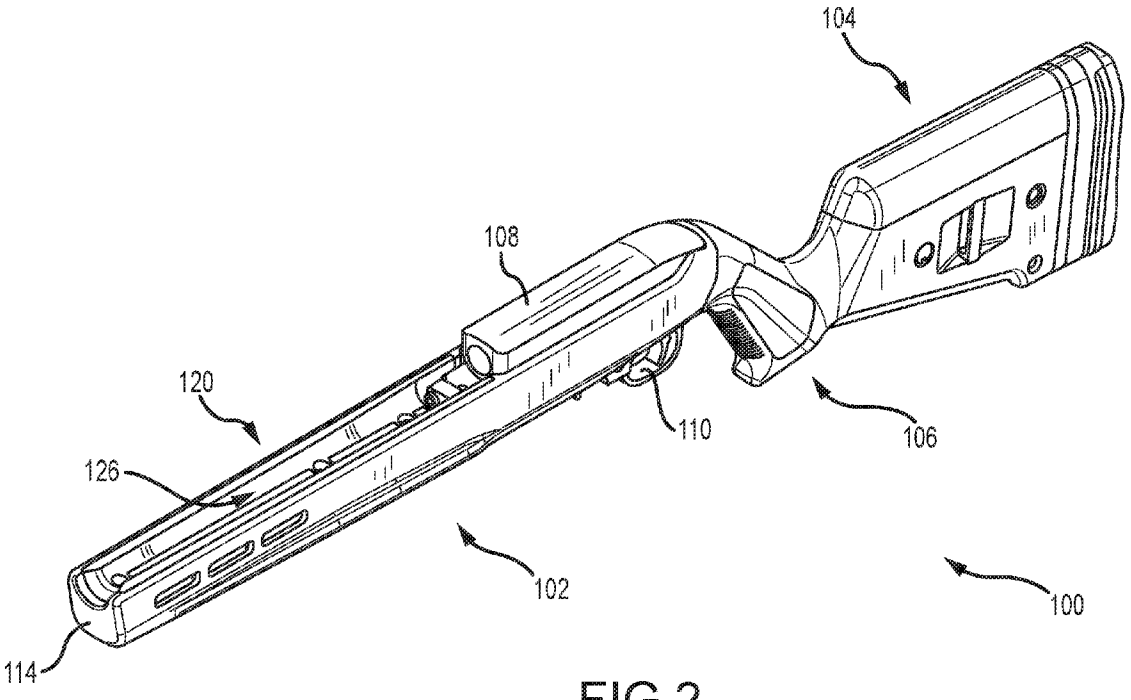
FIG. 2 shows another view of the stock of FIG. 1.
Figure 3:
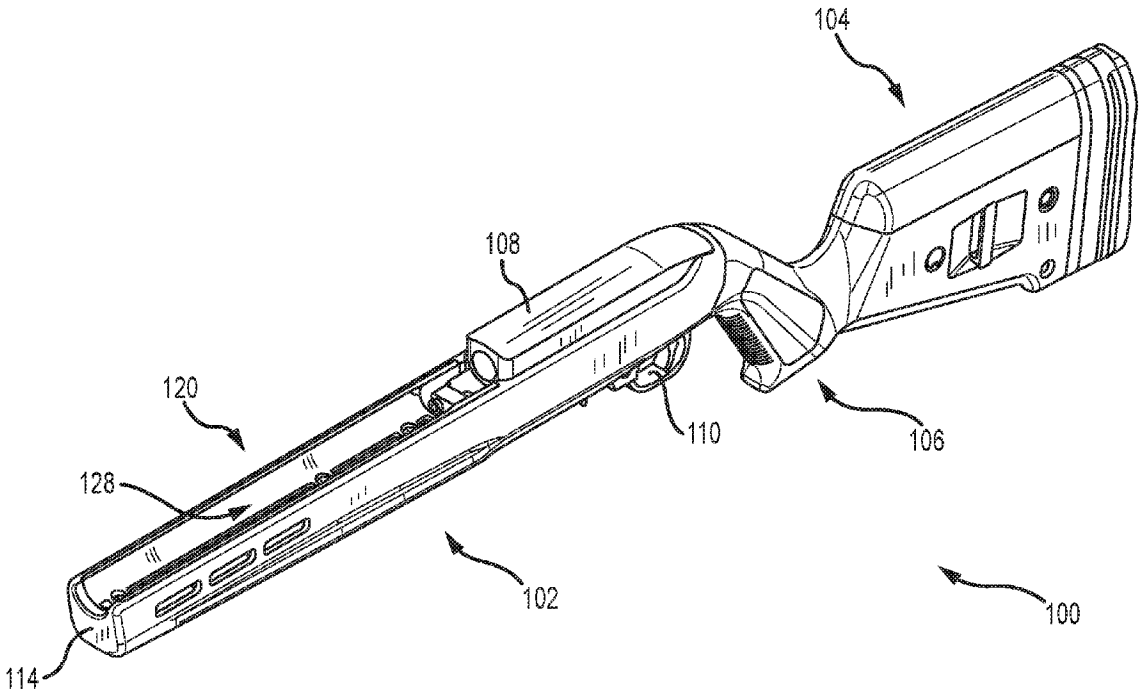
FIG. 3 shows yet another view of the stock of FIG. 1.
Figure 4:
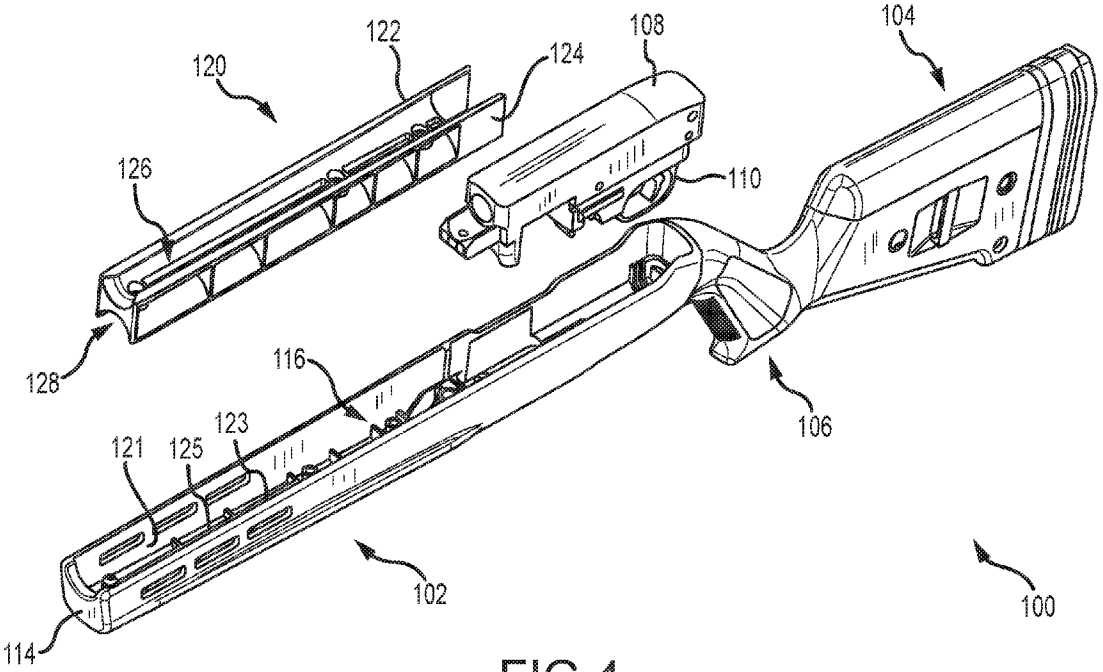
FIG. 4 shows an exploded view of the stock of FIG. 1.

FIGS. 1-4 illustrate different views of an embodiment of a firearm stock and selectable barrel support according to one embodiment of this disclosure. The selectable barrel support can be reversible, and therefore a selectable barrel support includes at least a reversible barrel support. FIG. 1 shows the firearm stock 100 including the selectable barrel support 120 (see FIGS. 2-4) implemented in a complete firearm 101. The stock 100 can include a forend 102 and a buttstock 104 coupled to each other, or further including a grip section 106 coupled between the forend 102 and the buttstock 104. In some embodiments, these two or three components can be modular and detachable. Modular means that a firearm user or a firearm manufacturer can combine any two modular parts to form a functional assembly. For instance, different forends 102 can be combined with different buttstocks 104 or different grip sections 106. In this way, the stock 100 can be manufactured in polymer at far less cost than if the whole stock 100 were manufactured as a single component.

The firearm 101 having the stock 100 can further include a receiver 108, a trigger assembly 110, and a barrel 112 coupled to the receiver 108. The barrel can rest on the selectable barrel support 120.

Figure 7A:
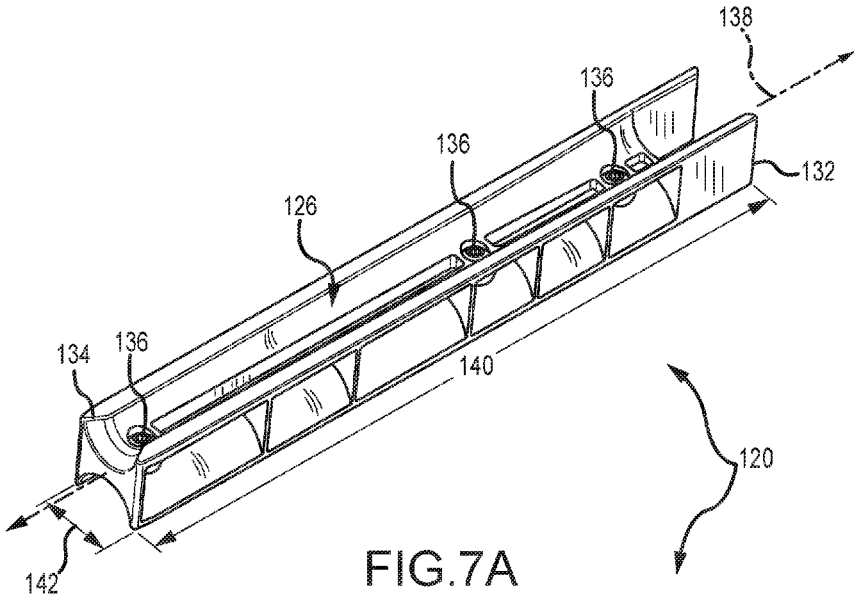
FIG. 7A shows an additional view of the selectable barrel support of FIGS. 1-4.
Figure 7B:
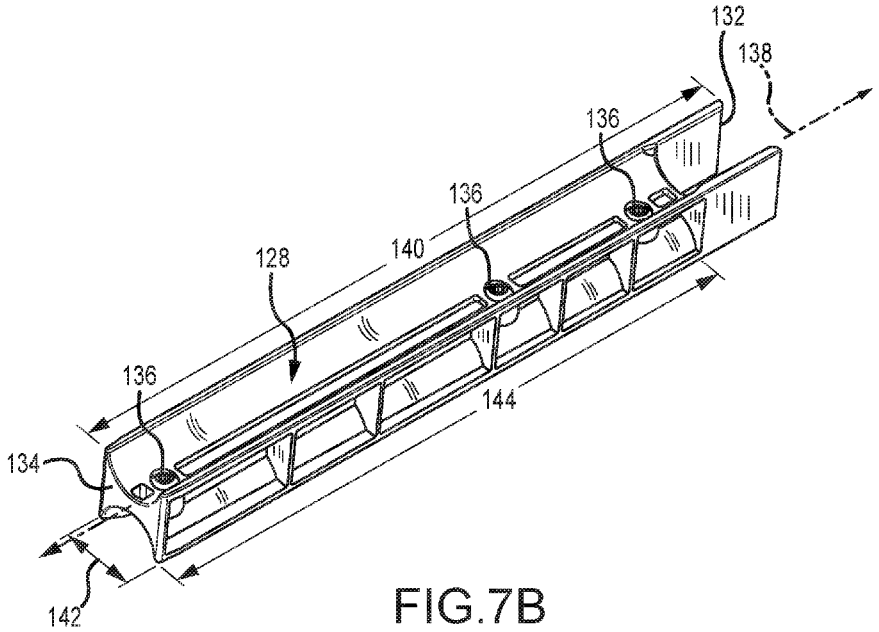
FIG. 7B shows an additional view of the selectable barrel support of FIGS. 1-4.
Figure 8:
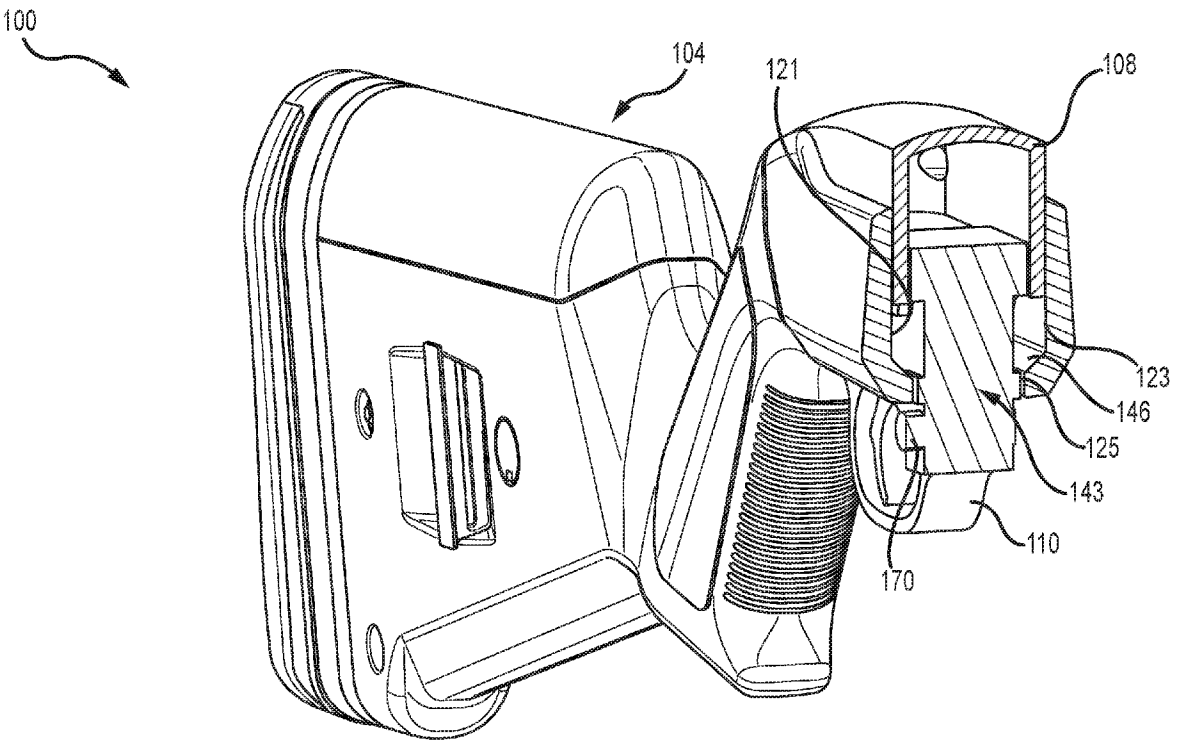
FIG. 8 shows a cross section of the trigger guard region of the firearm of FIG. 1.
Figure 9:
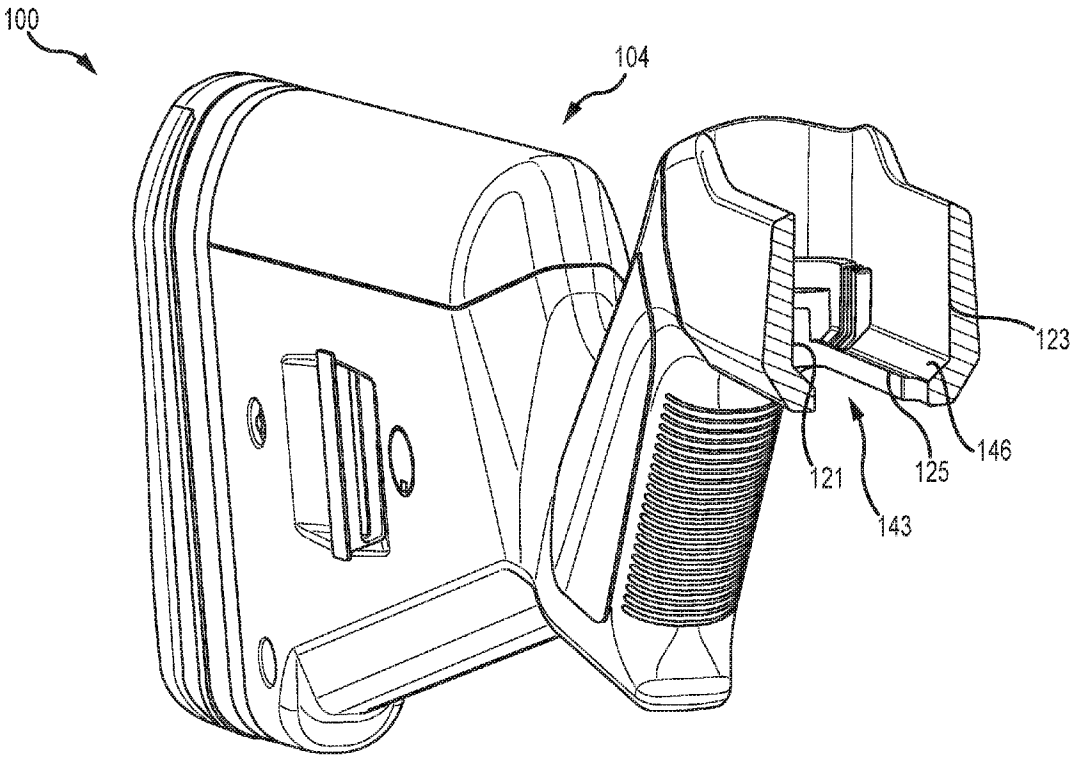
FIG. 9 shows another cross section of the trigger guard region of the firearm of FIG. 1 but without showing the action.
Figure 10:
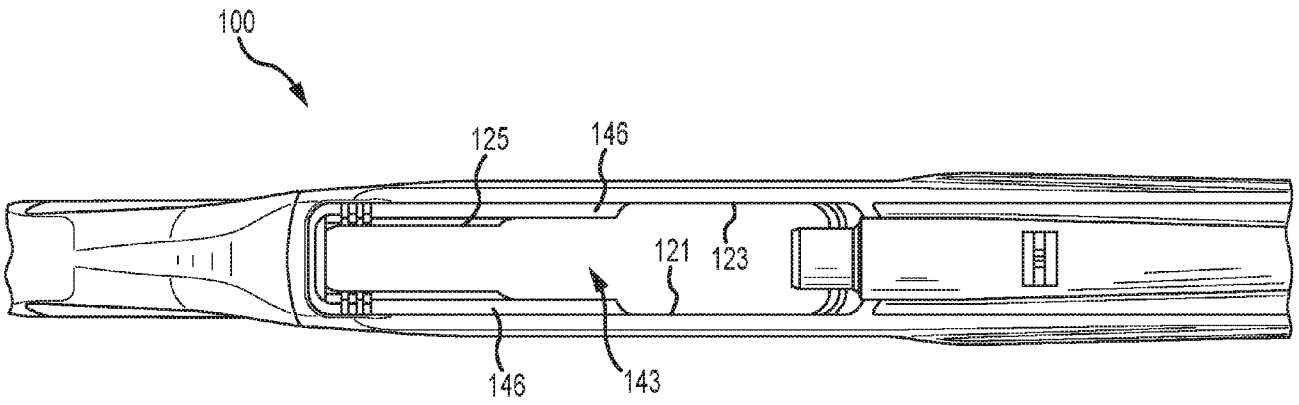
FIG. 10 shows yet another top view of the trigger guard region of the firearm of FIG. 1 but without showing the action.
Figure 11:
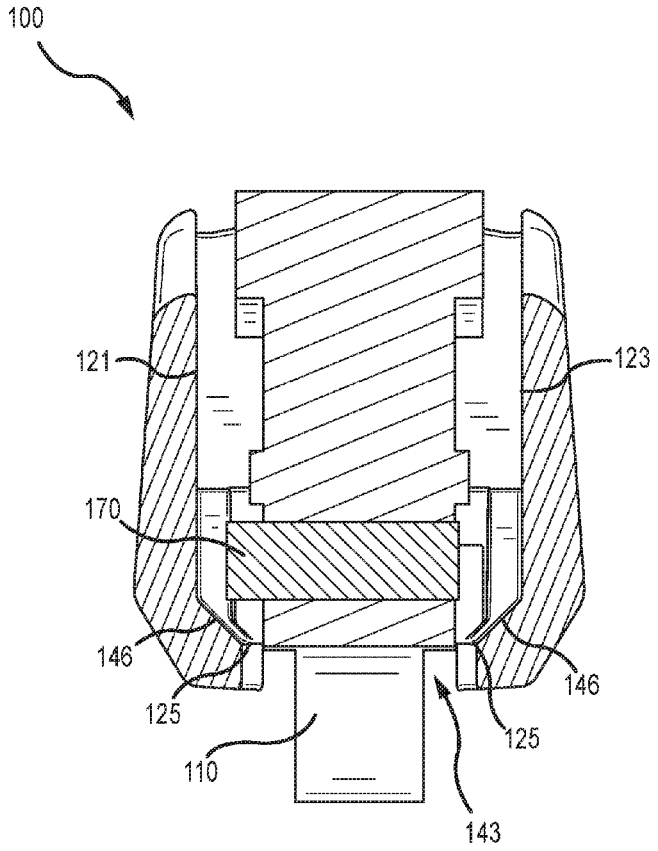
FIG. 11 shows a cross sectional view of the trigger guard region of the firearm of FIG. 1 but without showing the receiver.

The forend 102 can extend from behind the receiver 108 to a front end of the forend 114. The illustrated stock 100 is shown with a receiver 108 and a trigger assembly 110 inserted in the stock 100. The forend 102 can include a recess 116 formed from first and second inner sides 121, 123 and an inside bottom 125. The forend 102 can include a selectable barrel support 120 (see FIGS. 2-4) shaped to fit into the recess 116 in the forend 102, and can include an elongate frame having a longitudinal axis 138 (see FIGS. 7A and 7B) parallel to a longitudinal axis of the stock 100. A longitudinal dimension 140 of the selectable barrel support

Figure 5:
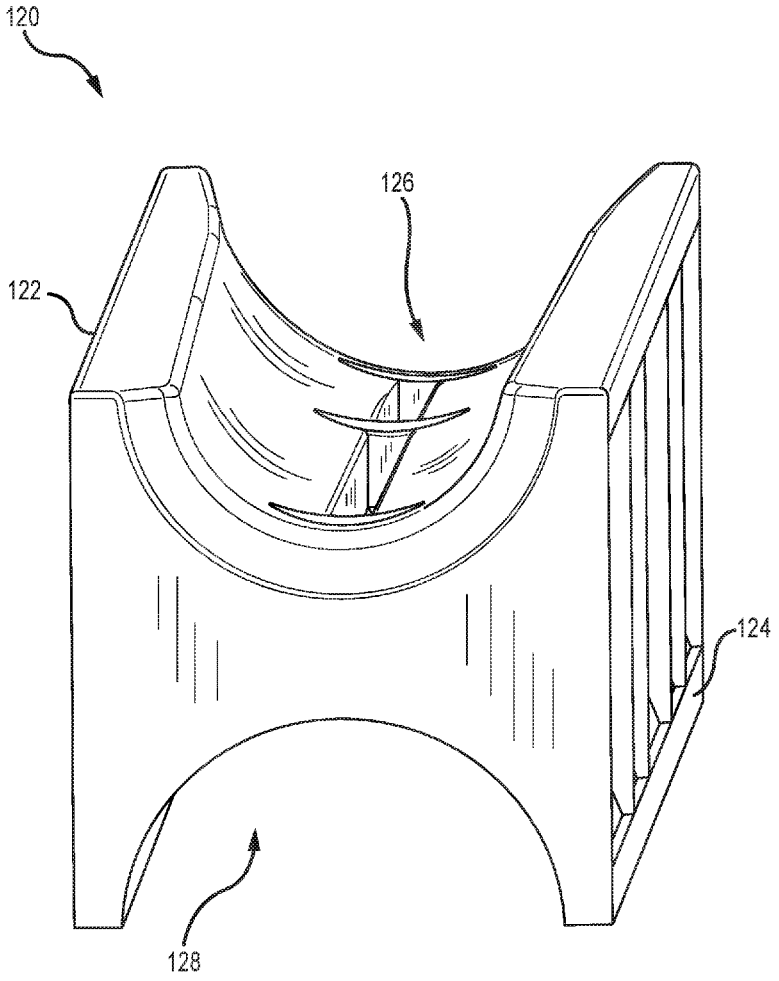
FIG. 5 shows the selectable barrel support of FIGS. 1-4.
Figure 6:
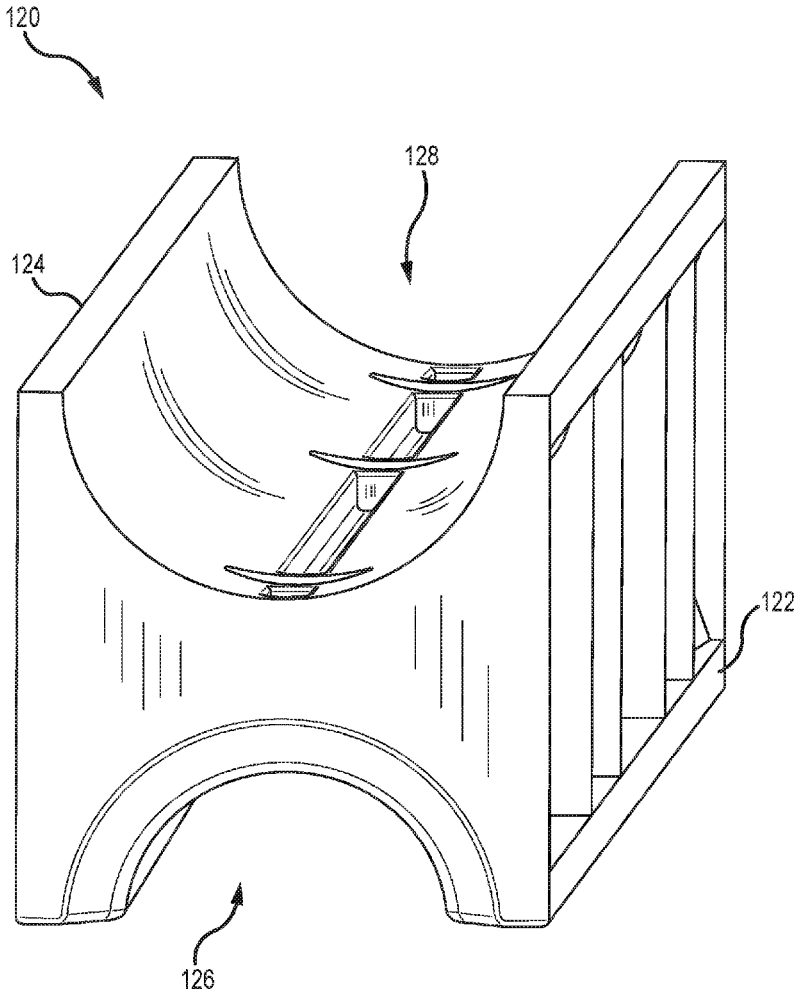
FIG. 6 shows another view of the selectable barrel support of FIGS. 1-4.

120 extending from proximal a front end of the forend 114 to proximal a front end of the receiver 108 of the firearm 101 along the longitudinal axis 138 can be greater than a lateral dimension 142 of the elongate frame. The selectable barrel support 120 can include a first side 122 and a second side 124 (see FIGS. 5-6), each side 122, 124 shaped to fit a respective inner side 121, 123 of the stock 100. The shape of the first and second sides 122, 124 and the respective inner sides 121, 123 can be such that the selectable barrel support 120 releasably forms a snap, friction, or interference fit with the recess 116 in the forend 102.

The selectable barrel support 120 includes a first concave barrel recess 126 and a second concave barrel recess 128, each arranged on separate sides (e.g., opposing or adjacent sides) of the selectable barrel support 120, and each configured to support a different type of barrel when the selectable barrel support 120 is engaged in the forend 102 of the firearm stock 100. However, the selectable barrel support 120 can also be configured to support more than two different barrel types. In the illustrated embodiment, the first concave barrel recess 126 is shaped to support a tapered barrel, while the second concave barrel recess 128 is shaped to support a bull barrel or competition barrel. To do this, the first concave barrel recess 126 has radii at fore and aft portions shaped to support a first barrel type (e.g., a tapered barrel 112), and the second concave barrel support 128 has radii at fore and aft portions shaped to support a second barrel type. In particular, the firearm 101 of FIG. 1 has a tapered barrel 112, and the first concave barrel recess 126 of the selectable barrel support 120 faces upward toward the barrel 112 and supports the barrel 112. In this embodiment, the first concave barrel recess 126 has a greater radius at an aft portion 132 than at a fore portion 134. The second concave barrel recess 128 is illustrated with an equal radius at fore and aft portions 134, 132 of the first concave barrel recess 126. However, the second concave barrel recess 128 can have a radius at the fore portion 134 that is equal to or greater than a radius at the aft portion 132 (e.g., where a bull barrel or competition barrel has a reverse taper—tapering from the muzzle toward the chamber). Said another way, the radii at the fore and aft portions of the first concave barrel recess 126 can be equal and the radii at the fore and aft portions of the second concave barrel recess 128 can be unequal.

In some embodiments, the first and second concave barrel recesses 126, 128 can be configured to support barrel types other than bull or tapered barrels. For instance, one type of supported barrel can include a stepped or staggered barrel having two or more cylindrical sections, where no two adjoining sections have the same radius. Other barrel types may taper toward a middle of the barrel and then flare toward the opposing end, thus very roughly being referred to as an hourglass shape (e.g., an M16 barrel). Other barrel types may include a combination of steps as well as tapering. Some barrel types can use a stepped or staggered shape to approximate a tapered barrel (i.e., an average radius of the barrel along its length tapers). Whatever the barrel types, the first and second concave barrel recesses 126, 128 can be configured and shaped to support any one or more barrel types (e.g., bull, tapered, staggered, hourglass, etc.), such that rotating the selectable barrel support 120 allows two or more different barrel types to be installed on the firearm 101 without a change in the stock 100.

The selectable barrel support 120 has been shown and described as having two concave barrel recesses 126, 128. Yet, in other embodiments, three or more concave barrel recesses can be implemented. For instance, a selectable barrel support (or a rotatable barrel support) having three sides, and one concave barrel recess in each of those three sides, can be implemented (see, for example, FIG. 15). In such an embodiment, the forend 102 can include a recess 116 shaped like a "V", having angled ribs to support two of the three sides of the selectable barrel support, or any other structure shaped to support and/or engage with the three-sided selectable barrel support. In another embodiment, the concave barrel recess can include four sides, each having a concave barrel recess configured to support a different barrel type (see, for example, FIG. 16).

Figure 15:
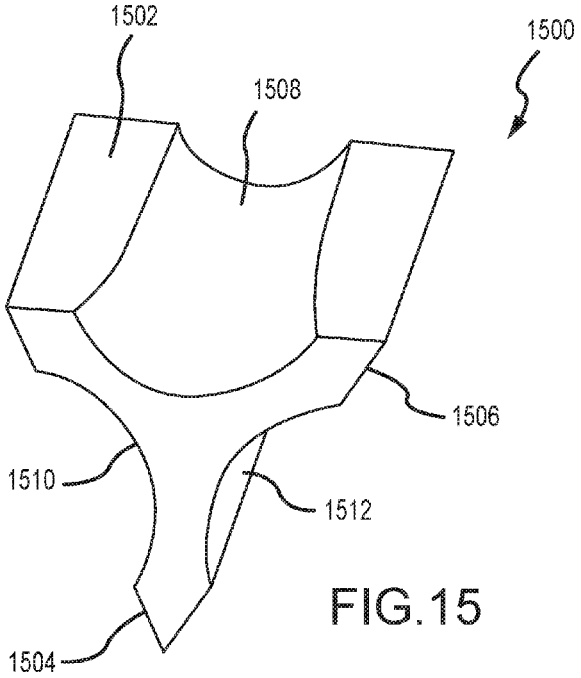
FIG. 15 shows another embodiment of a selectable barrel support.

FIG. 15 shows yet another embodiment of a selectable barrel support. The selectable barrel support 1500 includes three sides 1502, 1504, 1506 each arranged on separate (or adjacent) sides of the selectable barrel support 1500, and each configured to support a different type of barrel when the selectable barrel support 1500 is engaged in the forend of a firearm stock. At least the first concave barrel recess 1508 is illustrated as shaped to support a tapered barrel, and the figure is shown from an aft perspective such that a muzzle of a barrel supported by the tapered barrel support 1500 would be directed into the page.

Figure 16:
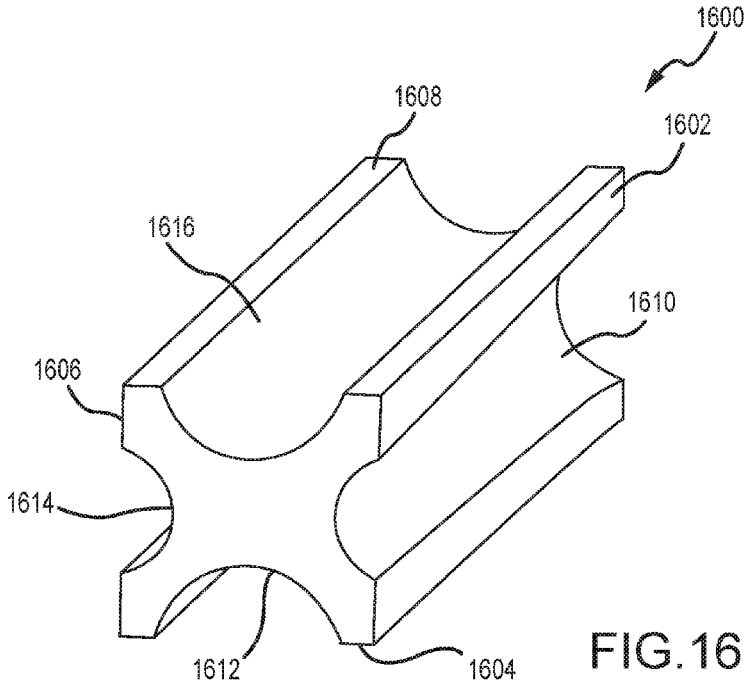
FIG. 16 shows yet another embodiment of a selectable barrel support.

FIG. 16 shows yet another embodiment of a selectable barrel support. The selectable barrel support 1600 includes four sides 1602, 1604, 1606, 1608 each arranged on separate sides of the selectable barrel support 1600, and each configured to support a different type of barrel when the selectable barrel support 1600 is engaged in the forend of a firearm stock. At least the first concave barrel recess 1610 is illustrated as shaped to support a tapered barrel, and the figure is shown from a fore perspective such that a muzzle of a barrel supported by the tapered barrel support 1600 would be directed out the page. One of the four concave barrel recesses 1610, 1612, 1614, 1616, and it's corresponding side 1602, 1604, 1606, 1608 would typically be arranged facing upward toward a barrel of a firearm, while an opposing side 1602, 1604, 1606, 1608 would face downward into the forend of the firearm. As illustrated, the fourth side 1608 and the fourth concave barrel recess 1616 face upwards towards where a barrel might reside, while the opposing side, the second side 1604, as well as its corresponding second concave barrel recess 1612, face downward. The second and fourth concave barrel recesses 1612, 1616 are shaped to support a bull barrel, while the first concave barrel recess 1610 is shaped to support a tapered barrel.

Returning to FIG. 1, the selectable barrel support 120 is inserted in the stock 100 such that the first concave barrel recess 126 is oriented upward to support a barrel 112 (e.g., a tapered barrel) while the second concave barrel recess 128 is oriented downward toward a bottom of the recess 116 of the forend 102. In this arrangement, the barrel 112 can rest in the first concave barrel recess 126 and contact the selectable barrel support 120. Similarly, when the second concave barrel recess is oriented upward toward the barrel 112, the barrel 112 can rest in the second concave barrel recess 128 and contact the selectable barrel support 120. However, the selectable barrel support 120 can also be used with free-float barrels or assemblies and in these cases, while a free-float barrel may fit partially into the first and/or second barrel recesses 126, 128, the barrel does not contact the selectable barrel support 120. In the illustrated embodiments, the first and second concave barrel recess 126, 128 have a longitudinal dimension 144 that is less than the longitudinal dimension 140 of the selectable barrel support 120.

To enable the selectable barrel support 120 to be releasably held in the forend 102 to the firearm stock 100, the selectable barrel support 120 can be shaped so as to have a snap fit, friction fit, or interference fit with the recess 116 (e.g., a snap, friction, or interference fit with one or more of the first inner side 121, the second inner side 123, and the inside bottom 125). Alternatively, and as illustrated, the selectable barrel support 120 can include one or more optional fastener apertures enabling optional fasteners 136 to be used to secure the selectable barrel support 120 to the stock 100 or to the forend 102 (these are not required as the barrel 112 can also perform the role of holding the selectable barrel support 120 to the stock 100). The illustrated embodiment includes three optional fasteners 136 with corresponding apertures in the forend 102, but this number is not limiting, and greater than or less than three can be implemented. In some cases, no fasteners are implemented. For instance, the selectable barrel support 120 may be releasably held in place via a snap, friction, or interference fit with the first and second inner sides 121, 123. The releasable hold on the selectable barrel support 120 can be aided by contact with a bottom of the barrel 112. In other instances, limited or no friction between the barrel support 120 and the forend 102 exists, and instead, contact from a bottom of the barrel 112 holds the barrel support 120 in place. Further, in some instances, a combination of fasteners, and a snap, friction, or interference fit can be implemented. While the illustrated optional fasteners 136 are round-head screws, other types of fasteners can also be used without departing from the scope and spirit of the disclosure.

In some embodiments, the firearm stock 100 can also include structure to assist a firearms user to insert the trigger assembly 110 into the stock 100 (see FIGS. 8-13). A typical safety pin 170 of the trigger assembly 110 has two stable manufacturer-intended positions: fire or safe. In both of these positions, the safety pin 170 extends laterally from the trigger assembly 110 perpendicularly to the longitudinal axis of the stock 100. For instance, in FIGS. 8, 11, and 13 the safety pin 170 extends to a left of the trigger assembly 110, which can either be a safe or fire position, depending on specifications of the firearm 101. In order to insert the trigger assembly 110 into the stock 100 or remove the trigger assembly 110 from the stock 100, the trigger assembly 110 must pass at least partially through an aperture 143 (e.g., having a substantially rectangular shape). In the safe or fire positions, the safety pin 170 typically extends beyond a perimeter of the aperture 143 (see FIG. 11), and thus the trigger assembly 110 cannot pass at least partially through the aperture 143 while the safety pin 170 is in either the safe or fire positions (e.g., either extending to the left or right of the trigger assembly 110). Therefore, a user typically 'centers' the safety pin 170 between the safe and fire positions, which is an unstable arrangement not intended by manufacturers and one not easily achieved or maintained while the trigger assembly 110 is being passed through the aperture 143.

Figure 12:
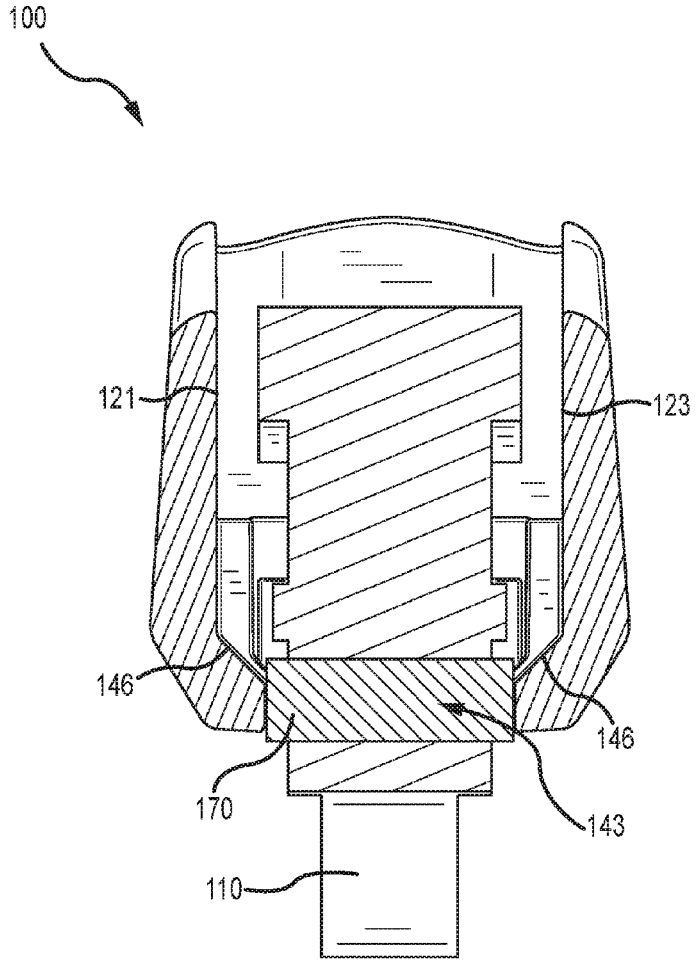
FIG. 12 shows another cross sectional view of the trigger guard region of the firearm of FIG. 1 but without showing the receiver.
Figure 13:
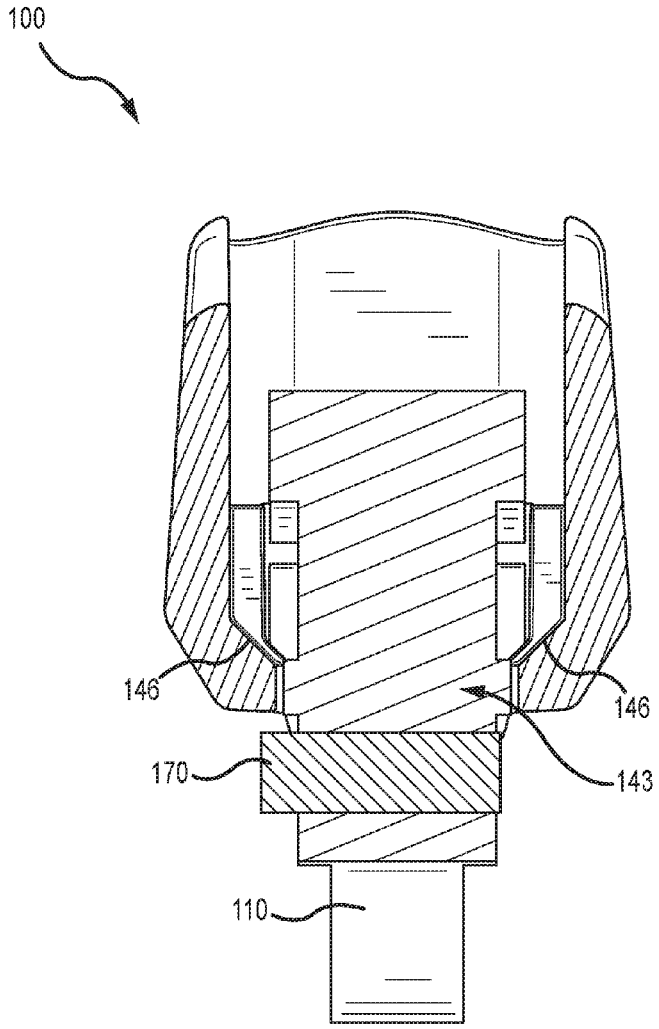
FIG. 13 shows yet another cross sectional view of the trigger guard region of the firearm of FIG. 1 but without showing the receiver.

To overcome this challenge, the herein disclosed stock 100 can include angled faces 146 that are adjacent to the first and second inner sides 121, 123 and the inside bottom 125 of the stock 100. These angled faces 146 are shaped to urge the safety pin 170 to the 'centered' position (i.e., centered across the trigger assembly 110, see for instance, FIG. 12) when the trigger assembly 110 is inserted into the stock 100 and passed at least partially through the rectangular aperture 143. Once the safety pin 170 has passed through the aperture 143, the safety pin 170 can return to the safe or fire position under the force of its own internal structure (i.e., since the 'centered' position of FIG. 12 is unstable), as shown in FIG. 13.

The stock 100 is illustrated as being configured for a RUGER 10/22 platform, other firearms platforms, including other .22 caliber firearms and firearms of different calibers, can also use the herein disclosed features.

Figure 14:
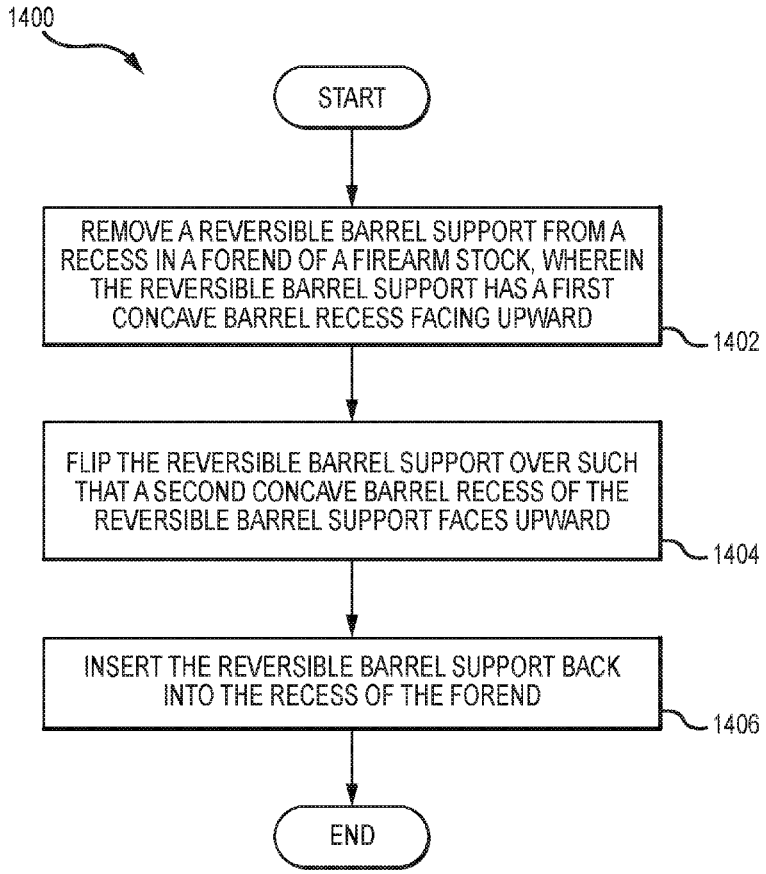
FIG. 14 shows a method of attaching a reversible barrel support to a firearm stock.

FIG. 14 illustrates a method of attaching a selectable (or reversible) barrel support to a firearm stock. The method 1400 includes removing a reversible barrel support from a recess in a forend of a firearm stock, wherein the reversible barrel support has a first concave barrel recess facing upward (Block 1402). For the purposes of this disclosure, upward can reference a vector starting at a bottom of a forend and traversing toward a barrel of the firearm. In an embodiment, this reversible barrel support can be shaped to fit two different barrel types, for instance a bull or competition barrel, and a tapered barrel tapering from the chamber toward the muzzle. The first concave barrel recess can be shaped to support a first barrel type, and a second concave barrel recess can be shaped to support a second barrel type. Where either or both barrel types are floating, the term "support" may not include physical contact between the reversible barrel support and the one or more floating barrels. The reversible barrel support may be releasably held in place via a snap, friction, or interference fit with first and second inner sides of the forend. This releasable hold on the reversible barrel support can be aided by contact with a bottom of the barrel. In other instances, limited or no friction between the barrel support and the forend exists, and instead, contact from a bottom of the barrel holds the barrel support in place. The method 1400 further includes flipping the reversible barrel support over such that a second concave barrel recess of the reversible barrel support faces upward (Block 1404), and inserting the reversible barrel support back into the recess in the forend (Block 1406). The method 1400 can be reversed and can be repeated as many times as desired. Further, the method 1400 can be implemented when switching between any two different types of barrels.

Turning now to FIGS. 17-21, some embodiments of the selectable barrel support 720 and/or a tensioning mechanism 750 are now described in further detail, with a general explanation of the embodiments in FIGS. 17-21 preceding the detailed explanation.

First, put broadly, the tensioning mechanism 750 may be provided so as to introduce a tensioning or expanding force between the barrel 112 and the insert 720 (and, ultimately, the forend 702). This is in contrast to the barrel band previously mentioned in the background of this document, which compresses the barrel and the forend together. In doing so, Applicants have introduced to users the ability to finely tune a relatively inexpensive or lighter rifle in a manner that competes with more expensive and finely toleranced rifles.

Figure 17:
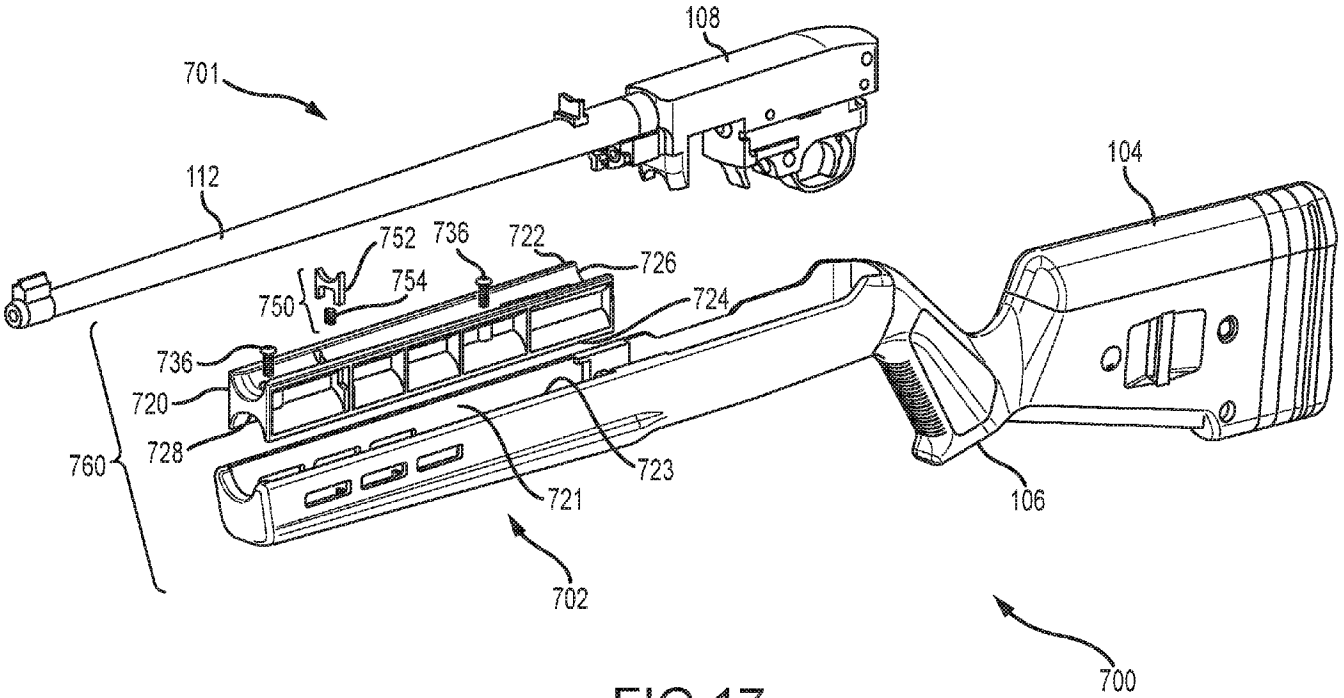
FIG. 17 shows a firearm stock including a selectable barrel support implemented in a complete firearm according to some embodiments.
Figure 19:
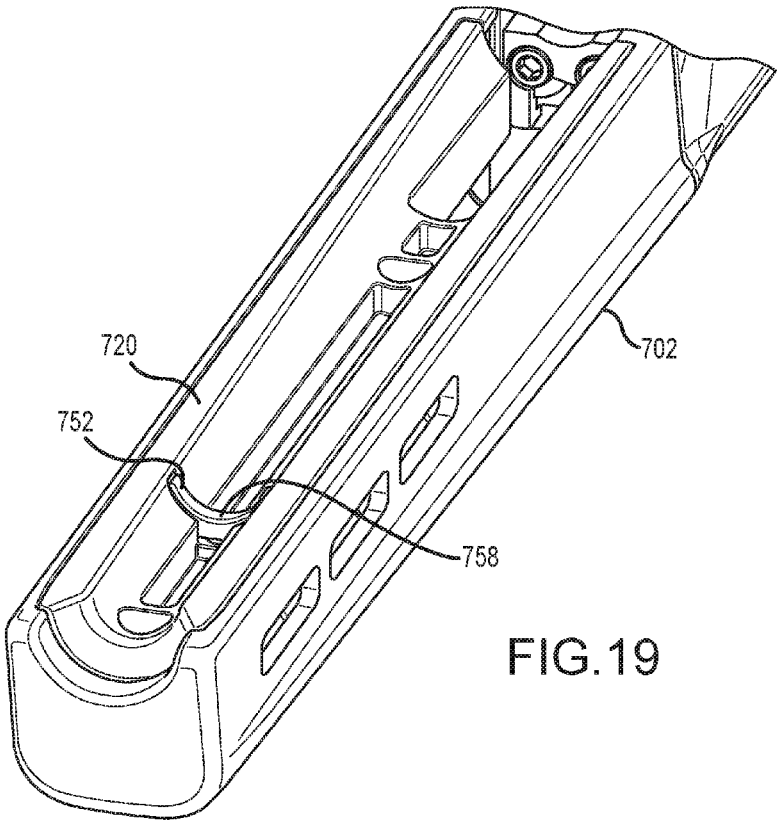
FIG. 19 illustrates a detail of the selectable barrel support and tension mechanism in FIG. 17.

In some embodiments, a tensioning mechanism 750 may be provided so as to enable a user to adjust a relationship between the barrel 112 and the selectable barrel support 720. For example, tolerance stack-up across multiple components and/or manufacturing inconsistencies in the barrel 112 and/or the selectable barrel support 720 or forend 702 may result in the selectable barrel support 120 (illustrated and described with reference to FIGS. 1-16) not fully contacting the barrel 112 and/or a loose relationship between the barrel 112 and the selectable barrel support 120. To overcome this potential problem, the user may adjust the tensioning mechanism 750, seated in the selectable barrel support 720, as illustrated in FIGS. 17 and 19.

In some embodiments, the selectable barrel support 720 is shaped to distribute a concentrated force from the tensioning mechanism 750 (caused by the barrel 112) across a broader surface area on the forend 702, while simultaneously roughly limiting motion between the barrel 112 and the selectable barrel support 720, providing a strengthening and/or stiffening effect to the barrel 112 or forend 702, and/or providing an additional barrier (such as supplemental to the forend 702) between a user and the barrel 112.

When referencing features illustrated in FIGS. 17-21, unless otherwise described, the features are substantially as illustrated and described with reference to FIGS. 1-16.

As previously described with reference to FIGS. 1-16, the selectable barrel support 720 may be provided with a first concave recess 726 and a second concave recess 728, (or third and fourth recesses, not illustrated), first and second sides 722, 724, and fastener(s) 736. These features are substantially as described with reference to first and second sides 122, 124, first and second concave recesses 126, 128, and fasteners 136, except as otherwise described below.

Similarly, the selectable barrel support 720 is configured for attachment to a firearm stock 700 having a forend 702 that is coupled to a buttstock 104 with a grip 106 substantially as previously described and illustrated, unless otherwise described below.

Some embodiments provide a firearm stock 700, a buttstock 104 coupled to the forend 702, a selectable barrel support 720, and a barrel tensioning mechanism 750. The firearm stock 700 may have a forend 702 comprising a recess formed from first and second inner sides 721, 723 and an inside bottom of the forend 702.

The selectable barrel support 720 may be removably seated in the recess in the forend 702, and is configured to support a barrel 112 of a completed firearm 701. As illustrated, the selectable barrel support 720 may have an elongate frame with a longitudinal axis and a first concave barrel recess 726 shaped to support a first barrel type (see e.g. barrel 112 illustrated in FIG. 17). The first concave barrel recess 726 may be positioned on a first side 722 of the elongate frame. A second concave barrel recess 728 shaped to support a second barrel type (for example a bull barrel, not illustrated) may be positioned on a second side 724 of the elongate frame.

Figure 20:
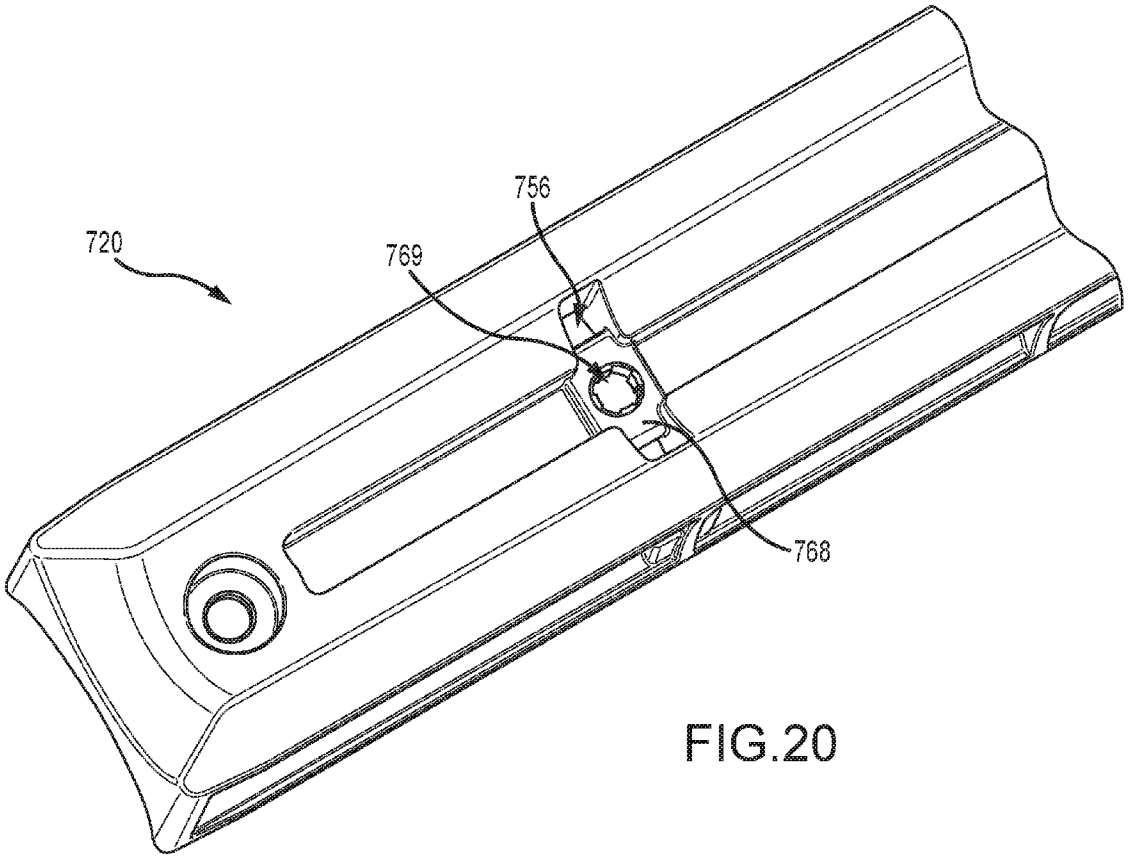
FIG. 20 illustrates a detail of the selectable barrel support in FIG. 17.
Figure 21:
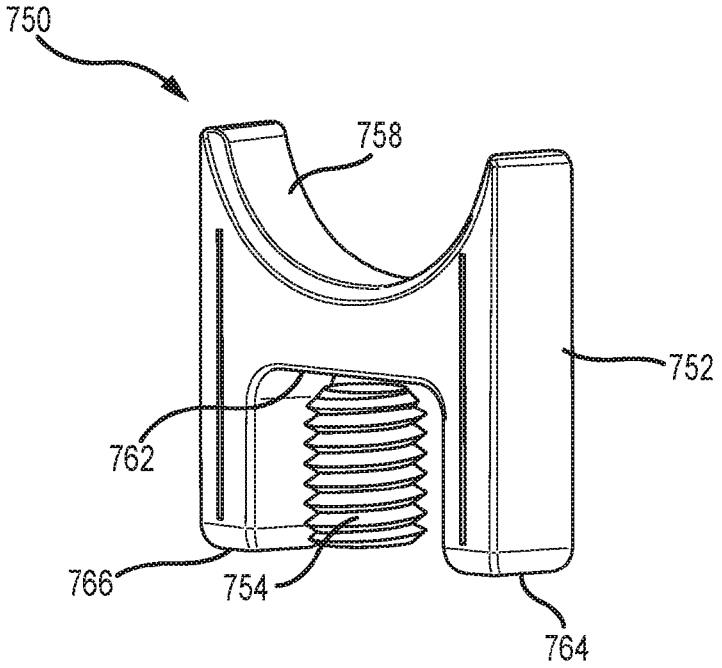
FIG. 21 is a perspective view of the tensioning mechanism in FIG. 17.

With specific reference to FIG. 21, a barrel tensioning mechanism 750 is provided in some embodiments. The barrel tensioning mechanism 750 may have a first support frame 752 and an adjustment mechanism 754. The adjustment mechanism 754 may be configured to be positioned between the first support frame 752 and the selectable barrel support 720 (see FIG. 17). By adjusting the adjustment mechanism 754 a seating position of the first support frame 752 can be moved between a first position wherein the first support frame 752 is substantially flush with the first concave barrel recess 726 or recessed in the first concave barrel recess 726, and a second position wherein the first support frame 752 protrudes into the first concave barrel recess 726. In some embodiments, the first support frame 752 has one or more legs 764, 766, which may serve to strengthen and/or align the support frame 752 relative to the selectable barrel support 720. Where a second support frame 772 (see e.g. FIG. 23) is provided, leg(s) 764, 766 of the first support frame 752 may abut or align with leg(s) 784, 786 of the second support frame 772 (not illustrated, and not required in all embodiments). In some embodiments, the leg(s) 764, 766 of a first support frame 752 may be unitary with or coupled to the leg(s) 784, 786 of a second support frame 772. In some embodiments, a first leg 764 in the first support frame 752 may abut, couple to, or be unitary with a first leg 784 in the second support frame 774. In some embodiments, first and second support frames 752, 772 may seat in the selectable barrel support 720 about a support surface 768 (see e.g. FIG. 20).

Although a threaded mechanism such as a screw is generally illustrated as the adjustment mechanism 754, those skilled in the art will understand that a thread is only one type of cammed feature, and that other cammed mechanisms may be suitable for use as an adjustment mechanism 754. Those skilled in the art will also recognize that other solutions for selective adjustment include, but are not limited to, detent mechanisms, interference fittings, gear mechanisms, levers, and/or other means known to those skilled in the art. A threaded mechanism nonetheless may be selected as the adjustment mechanism 754 so as to provide infinite adjustment, and, in turn, fine tuning capabilities between the barrel 112 and the barrel support 720 or forend 702.

Although not illustrated, in some embodiments, the tensioning mechanism 750 may be configured to apply a first pressure and a second pressure on the barrel 112. That is, in a first position, the tensioning mechanism 750 may be configured to not apply a pressure on the barrel 112, and, in contrast, the tensioning mechanism 750 may be configured to apply a pressure on the barrel 112 when in the second position. For instance, the actual position of the barrel 112 (relative to the selectable barrel support 720) may not change when the tensioning mechanism 750 is moved between the first and second positions, even though the tensioning mechanism 750 may touch or apply a force to the barrel 112 in either or both positions. Instead, what changes is the amount of force the tensioning mechanism 750 applies on the barrel 112. In other words, the pressure or tension can be used to dampen vibrations even without any noticeable physical differences in the barrel 112. In some embodiments, the tensioning mechanism 750 may be configured to apply a first force on the barrel 112 when in the first position, and a second force on the barrel 112 when in the second position, the second force greater than the first force. In some embodiments, the tensioning mechanism 750 may be configured to cause the barrel 112 and/or the forend 702 of the stock 700 to flex slightly, relative to the selectable barrel support 720 when the tensioning mechanism 750 is in the second position.

In some embodiments, the tensioning mechanism 750 is removable from the assembly; for example, the tensioning mechanism 750 may simply be seated in the selectable barrel support 720. In some embodiments, the tensioning mechanism 750 may be removably coupled to the selectable barrel support 720. For example, the adjustment mechanism 754 may be threaded to, cammed, or pass through the support body 752 to couple the tensioning mechanism 750 to the selectable barrel support 720. In some embodiments, any means of adjustably and/or removably coupling the tensioning mechanism 750 to the selectable barrel support 720 or the forend 702 are envisioned. Various means of fastening, including, without limitation, one or more of screws, levers, snap-fit mechanism, friction interfaces, or other fastening means now available or as-yet to be developed are envisioned to provide a removable coupling.

Relatedly, the first support body 752 may be removably coupled to the adjustment mechanism 754. For example, various means of fastening, including, without limitation, one or more of screws, levers, snap-fit mechanism, friction interfaces, or other fastening means now available or as-yet to be developed are envisioned to removably couple the first support body 752 to the adjustment mechanism 754.

Figure 18:
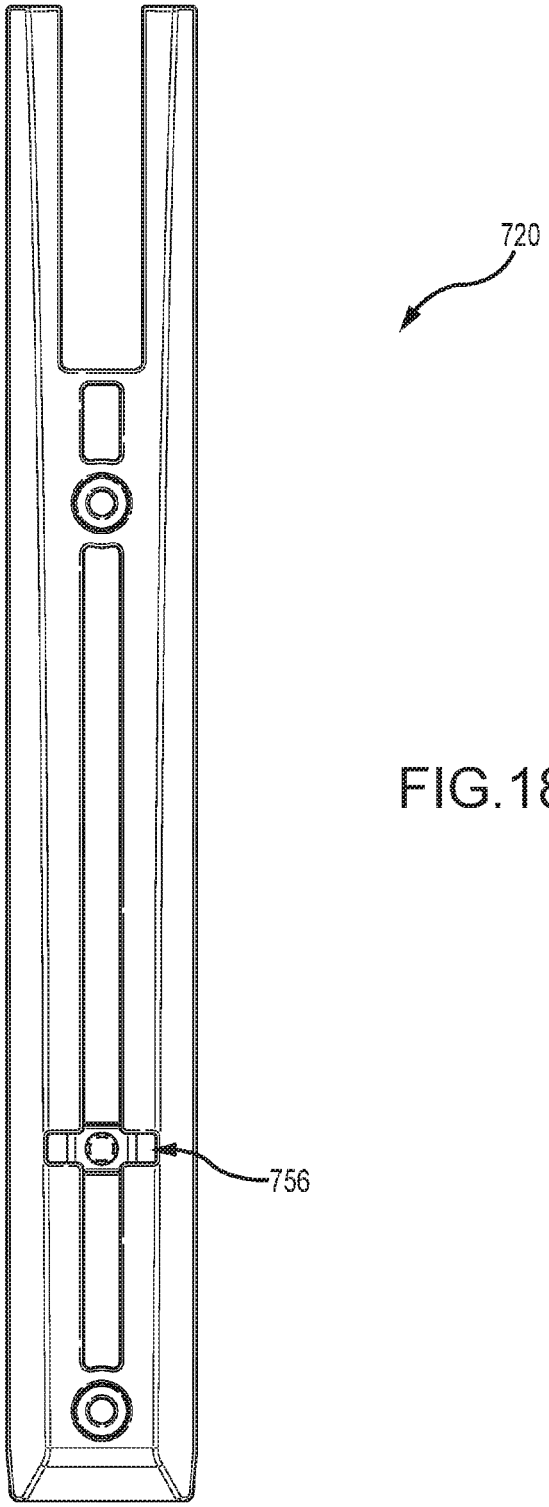
FIG. 18 is a top view of the selectable barrel support in FIG. 17.

Turning now to FIG. 18, the selectable barrel support 720 may have a recess 756 configured to receive a tensioning mechanism 750, or, put simply, the tensioning mechanism 750 may be seated in the selectable barrel support 720 at the recess 756. As illustrated in FIG. 20, the recess 756 may include a support surface 768 in the selectable barrel support 720. In some embodiments, the adjustment mechanism 754 may be a threaded or cammed fastener or set screw rotatingly engaged with a socket feature 769 in the selectable barrel support 720. Rotation of the adjustment mechanism 754 causes the adjustment mechanism 754 to move between a first position and a second position. When the adjustment mechanism 754 is in the first position and a user seats the support body 752 in the selectable barrel support 720, the support body 752 is in a first position in which a curved support surface 758 (see FIG. 21) in the main body 752 is substantially flush with or recessed in the first concave barrel recess 726. When the adjustment mechanism 754 is in the second position and a user seats the support body 752 in the selectable barrel support 720, the support body 752 is in a second position in which the curved support surface 758 (see FIG. 21) in the support body 752 protrudes into the first concave barrel recess 726. Those skilled in the art will understand that a surface 762 opposing the curved support surface 758 provides the ability to apply, using the adjustment mechanism 754 or screw, a counter force for supporting the barrel 112.

Causing the support body 752 (see FIG. 21) to protrude into the first concave barrel recess 726 in this manner may, when part of a complete firearm 701, eliminate problems of tolerance stack-up and/or manufacturing inconsistencies in the firearm 701, such as the barrel 112 and/or the selectable barrel support 720 and/or forend 702. For example, while the interior portions of a barrel 112 may be manufactured to a particular tolerance, the exterior of the barrel may be less controlled, resulting in potential adverse relationships between the barrel and the selectable barrel support 720. Moreover, after market manufacturers and/or modification may further exacerbate the problems with tolerances and inconsistencies.

In some embodiments, the selectable barrel support 720 is shaped to distribute a concentrated force from the tensioning mechanism 750 (caused by the barrel 112) across a broader surface area on the forend 702, while simultaneously roughly limiting motion between the barrel 112 and the selectable barrel support 720, providing a strengthening and/or stiffening effect to the barrel 112 or forend 702, and/or providing a barrier between a user and the barrel 112. In some embodiments, the tensioning mechanism 750 provides a user the ability to finely tune a position of the barrel 112 relative to the forend 702 to account for tolerance stack-up and other manufacturing inconsistencies in the barrel 112, the selectable barrel support 720, and/or the forend 702.

Figure 22:
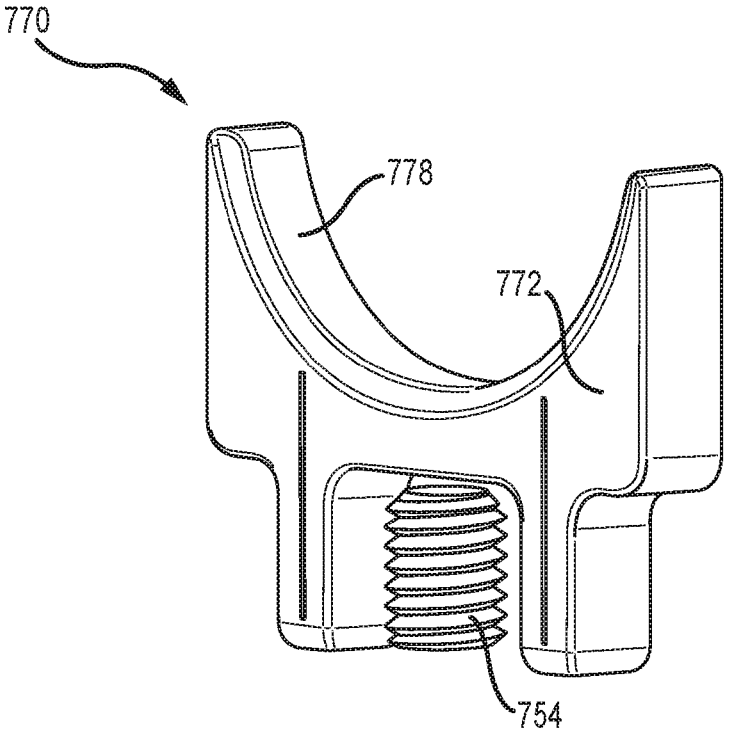
FIG. 22 is a perspective view of another tensioning mechanism suitable for use with the barrel support in FIG. 17.

With reference now to FIG. 22, in some embodiments, a second tensioning mechanism 770 having a second support frame 772 and optionally a second tensioning mechanism 754 may be provided. The second support frame 772 may have a curved support surface 778 configured to support a second barrel shape when protruding into a second concave barrel recess 728 of the selectable barrel support 720 (see e.g. FIG. 17 and FIG. 22).

In some embodiments, a firearm barrel support system 760 may be provided, as illustrated in FIGS. 17-21. The system 760 may have a selectable barrel support 720, a forend 702 for a stock 700, a tensioning mechanism 750, and one or more fasteners 736 for coupling the selectable barrel support 720 to the forend 702. The tensioning mechanism 750 may have a first support body 752 and an adjustment mechanism 754. In some embodiments, the tensioning mechanism 750 may include a second support body 772, or in some embodiments, a first tensioning mechanism 750 and a second tensioning mechanism 770 may be provided. In some embodiments, the first and second support bodies 752, 772 may be unitary with or coupled to each other.

Figure 23:
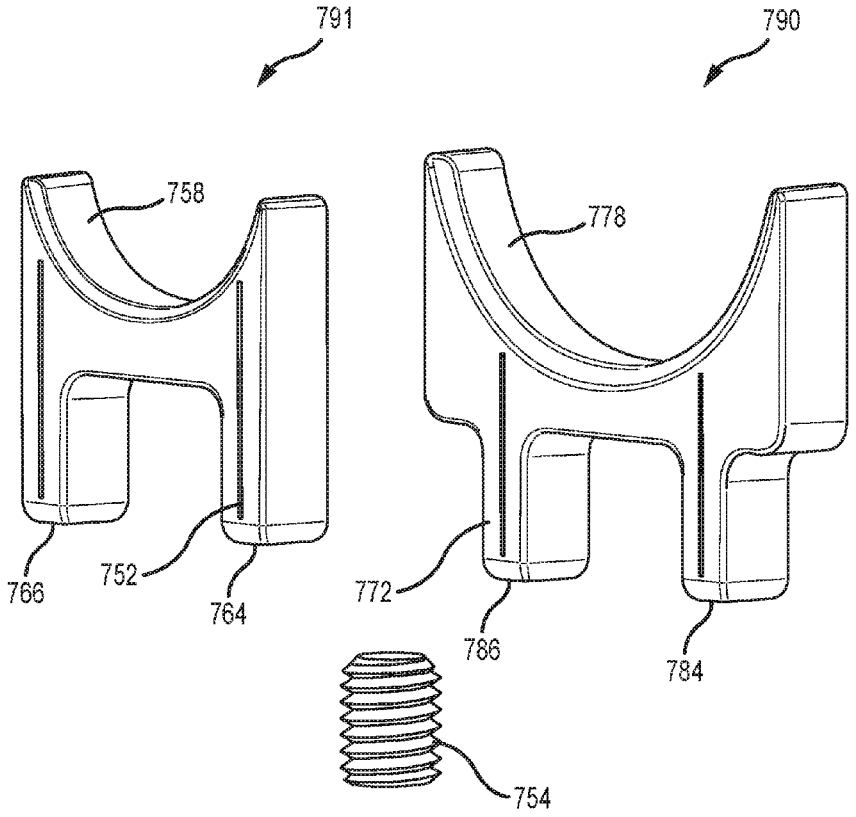
FIG. 23 is a perspective view of a tensioning kit according to some embodiments.

Turning now to FIG. 23, in some embodiments, a barrel support kit 790 may be provided. The barrel support kit 790 or tensioning mechanism 791 may include a first support frame 752, a second support frame 772, and an adjustment mechanism 754. That is, the first support frame 752 may be configured to conform to, sit flush with, or recess in the first concave barrel recess 726, and the second support frame 772 may be configured to conform to, sit flush with, or recess in the second concave barrel recess 728. Relatedly, the adjustment mechanism 754 may be configured to adjust either the first support body 752 and/or the second support body 772. The tensioning mechanism 791 may have a first support body 752, a second support body 772, and an adjustment mechanism 754.

Although the first and second support bodies 752, 772 and adjustment mechanism 754 are illustrated as separate components, those skilled in the art will readily envision a number of variations. For example, the first support body 752 and the second support body 772 may be unitary with each other or coupled together about the support surface 768 (see FIG. 20), with the adjustment mechanism 754 threaded to, cammed, or otherwise movably coupled to the socket feature 769. More specifically, the curved support surface 758 in the first support body 752 may be rotated 180 degrees relative to the curved support surface 778 in the second support body 772. In some embodiments, a passage (not illustrated) may be provided through the curved support surface 758, 778 in either or both of the support bodies 752, 772, to give a user access to one or more adjustment mechanisms 754 positioned between the kit 790 (or tensioning mechanism 791, or support bodies 752, 772) and the selectable barrel support 720.

In some embodiments, an aperture (not illustrated) may be provided in the forend 702, such as at a bottom or side of the forend 702, to give access to the adjustment mechanism 754 and/or tensioning mechanism 750. Specifically, the aperture may be positioned on a bottom side of the forend 702 (see FIG. 17), and shaped such that a user may access the adjustment mechanism 754 through the bottom of the forend 702. In some embodiments, a user may access and manipulate the adjustment mechanism 754 through the aperture in the forend 702 using a screwdriver or other device for rotating the adjustment mechanism 754, which may have a tool interface on the bottom side. In some embodiments, the user may repeatedly adjust the adjustment mechanism 754, and hence the tensioning mechanism 750, and fire the weapon 701 (see FIG. 17) without disassembling the forend 702 or other components from the barrel 112.

Figure 23A:
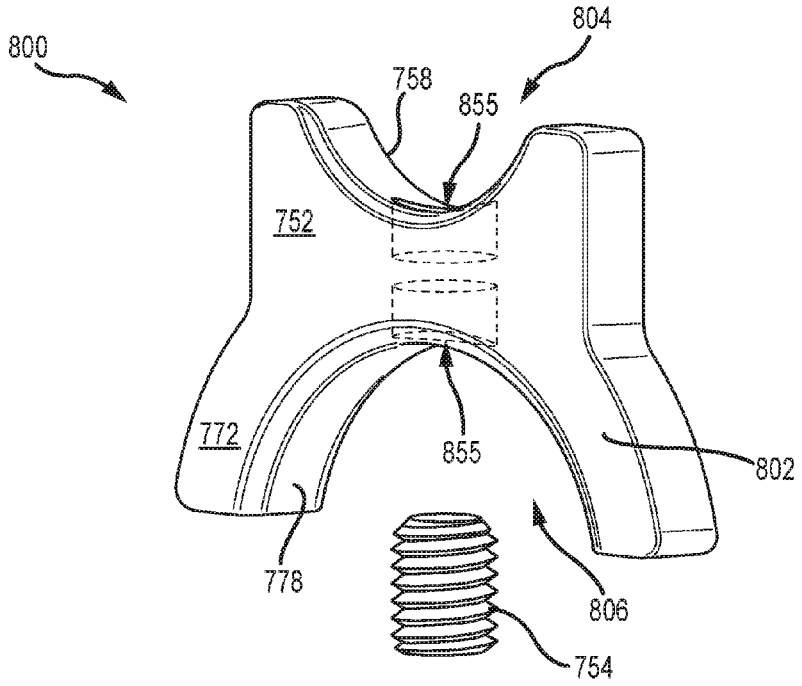
FIG. 23*a* is a perspective view of another tensioning mechanism according to some embodiments.

In some embodiments, and as illustrated in FIG. 23*a*, a tensioning mechanism 800 having a dual support 802 may be provided, wherein the dual support 802 has a first support body 752 with a first curved surface 758 on a first side 804 and second support body 772 with a second curved surface 778 on a second side 806, and a screw or other adjustment mechanism 754 configured to be positioned between the dual support 802 and the selectable barrel support 720.

Put another way, the first support body 752 and the second support body 772 may be unitary, permanently coupled to each other, or removably coupled to each other. Recesses 855 in the first and second support bodies 752, 772 may provide a stabilizing feature and/or an abutment against which the tensioning mechanism 800 may seat. Those skilled in the art will understand that, where the adjustment mechanism 754 is a threaded screw, the adjustment mechanism 754 may be threaded to the tensioning mechanism 750, 770, 800 or the selectable barrel support 720.

Figure 23B:
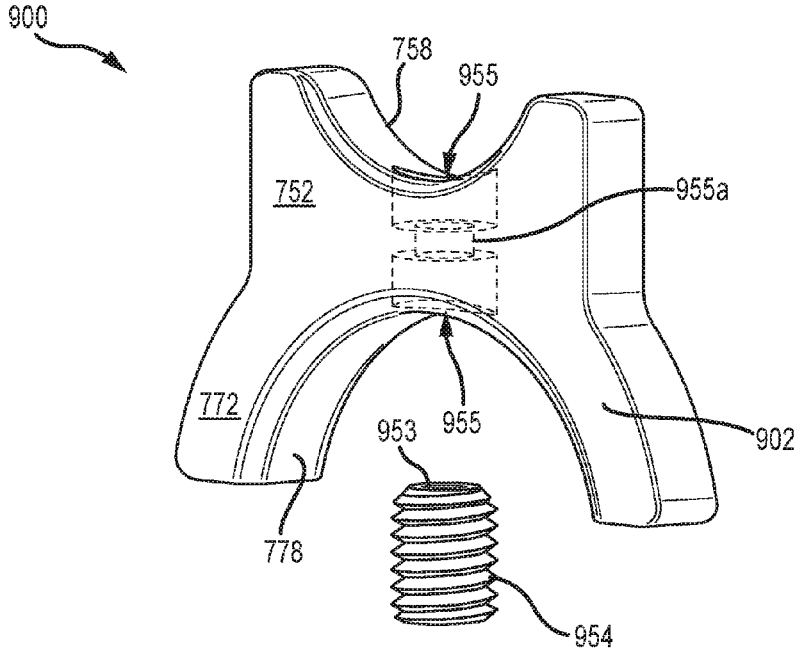
FIG. 23*b* is a perspective view of another tensioning mechanism according to some embodiments.

Turning now to FIG. 23*b*, in some embodiments, a tensioning mechanism 900 otherwise substantially as described with reference to FIG. 23*a* may be provided with a passage 955*a* through the dual support 902, to give a user access to the adjustment mechanism. For example, the adjustment mechanism 954 may be threaded or cammed to engage the socket feature 769 in the selectable barrel support 720 (see e.g. FIG. 20), and a user may adjust the adjustment mechanism 954 without unseating (or uncoupling or removing) the dual support 954, or, where applicable, the first and/or second support bodies 752, 772. For example, a tool engagement 953, such as a flathead interface, may be provided on the adjustment mechanism 954 for engagement with a tool through the dual support 902 or support body 752, 772. Those skilled in the art will understand that the passage and tool engagement features are applicable to other embodiments, including those illustrated in FIGS. 17-23.

Figure 23C:
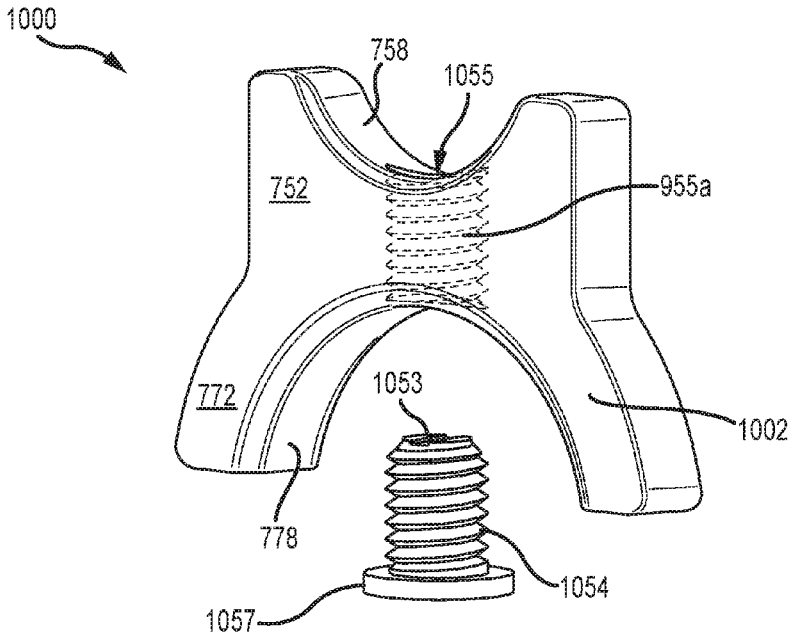
FIG. 23*c* is a perspective view of another tensioning mechanism according to some embodiments.

In some embodiments, the tensioning mechanism 1000, and as illustrated in FIG. 23*c*, the adjustment mechanism 1054 may be rotatingly coupled to or threaded to a dual support 1002, which may have a first support body 752 with a first curved surface 758 to abut a first barrel, and a second support body 772 having a second curved surface 778 to abut a second barrel. The adjustment mechanism 1054 may include a tool engagement feature 1053 on a first end and a barrel support interface 1057 on a second end.

Figure 23D:
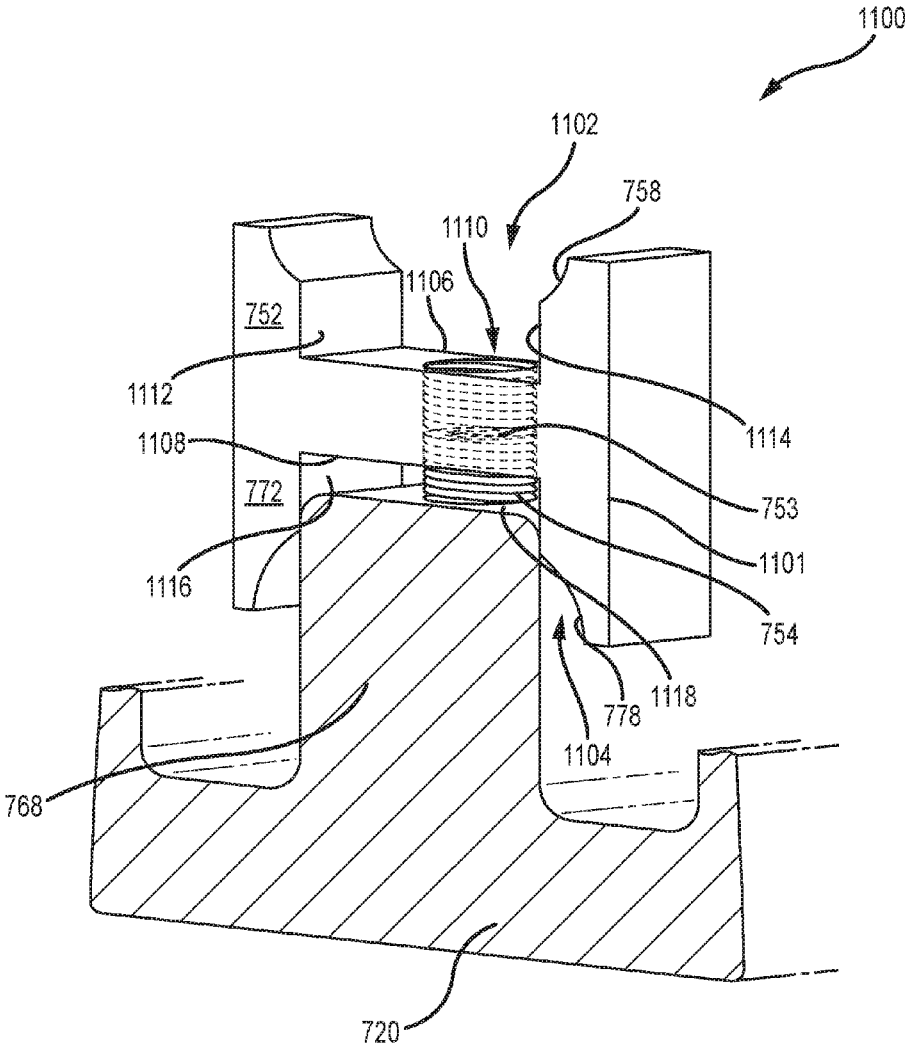
FIG. 23*d* is a perspective view of another tensioning mechanism according to some embodiments.

Turning now to FIG. 23*d*, in some embodiments, the tensioning mechanism 1100 may have a dual support body 1101 substantially as previously described, with a first support body 752 and a second support body 772 unitary with or coupled to the first support body 752. The first support body 752 has a first barrel interface 1102 with a first curved support surface 758 and a first flange 1106 recessed in the first curved support surface 758. That is, the first barrel interface 1102 may be configured to abut a first barrel of a firearm and alternatively abut a ledge or support surface 768 in a selectable barrel support 720. The second support body 772 similarly has a second barrel interface 1104 with a second curved support surface 778 and a second flange 1108 recessed in the second curved support surface 778. That is, the second barrel interface 1104 may be configured to abut a second barrel of a firearm and alternatively abut a ledge or support surface 768 in a selectable barrel support 720. In the embodiment illustrated in FIG. 24*d*, a passage 1110 in the dual support 1101 may be provided for rotatingly engaging an adjustment mechanism 754 that abuts a flange or support surface 768 in the selectable barrel support 720. The adjustment mechanism 754 may have a tool interface 753 such as a screwdriver interface on both ends, such that user rotation or adjustment of the adjustment mechanism 754 causes the adjustment mechanism 754 to move relative to the dual support 1101, and, in turn, adjust a seating position of the tensioning mechanism 1100 relative to the selectable barrel support 720. Those skilled in the art will understand that a user may first seat the tensioning mechanism 1100 with a first orientation to support a first barrel, remove the tensioning mechanism 1100, and seat the tensioning mechanism 1100 with a second orientation to support a second barrel. In either or both orientations, the user may adjust the adjustment mechanism 754 to adjust the seating position of the tensioning mechanism 1100 by inserting a tool through the passage 1110 to rotate the adjustment mechanism 754, or otherwise substantially as previously described herein.

Those skilled in the art can readily envision any number of variations to the tensioning mechanism 750, 770, 791, 800, 900, 1000, 1100 as taught herein without deviating from the scope of the invention as claimed.

To name just a few examples, those skilled in the art will understand that, although the dual support 802, 902, 1002, 1101 and support bodies 752, 772 described in the preceding paragraphs are illustrated with particular outer contouring, this feature is not necessary, and, specifically, the dual support 802, 902, 1002 and/or the support bodies 752, 772 may be modified so as to seat in or slide within the selectable barrel support 720 in a stable manner. Likewise, the selectable barrel support 720 may be configured to receive and constrict motion of the dual support 802, 902, 1002 and/or the support bodies 752, 772 in a stable manner.

Figure 23E:
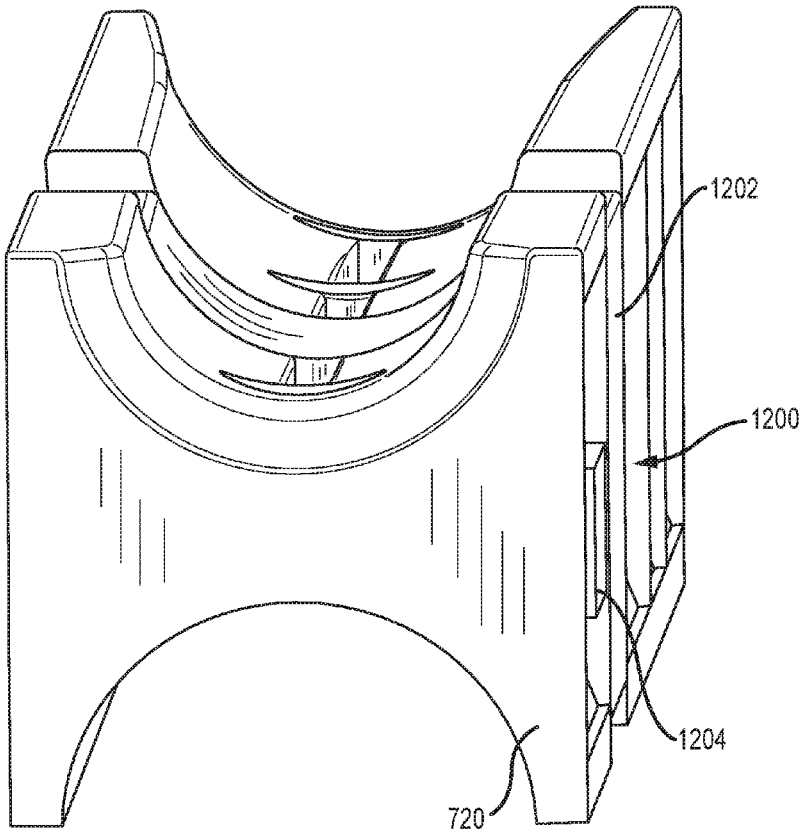
FIG. 23*e* is a perspective view of another tensioning mechanism according to some embodiments.

Moreover, as illustrated in FIG. 23*e*, a tensioning mechanism 1200 may have a dual support 1202 and an adjustment mechanism 1204. The adjustment mechanism 1204 may be include any feature such as, but not limited to, a rack and pinion mechanism, a detent system, a gear mechanism, a selective interference fit, a lever mechanism, a jack screw variant, and/or a lead screw, configured to effectuate linear motion of the dual support relative to the selectable barrel support 720.

Figure 23F:
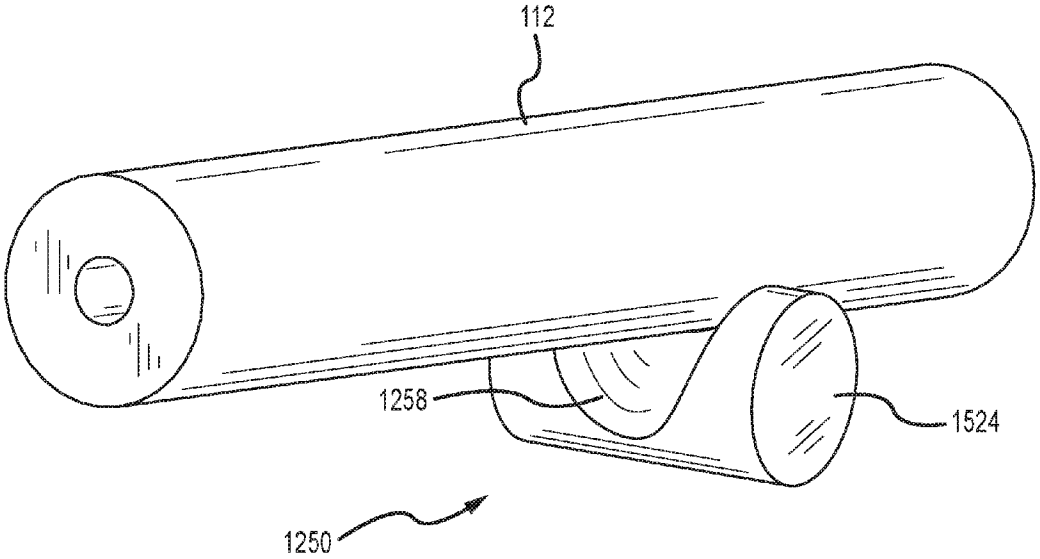
FIG. 23*f* is a perspective view illustrating features of another tensioning mechanism according to some embodiments.

Turning now to FIG. 23*f*, it illustrates a general layout of an embodiment of a tensioning mechanism 1250 and a barrel 112. In some embodiments, the tensioning mechanism 1250 may have a support surface 1258 and an adjustment mechanism 1254, such that manipulation of the adjustment mechanism 1254 may cause the tensioning mechanism 1250 and/or support surface 1258 to rotate about an axis that is transverse relative to the longitudinal axis of the barrel 112. The adjustment mechanism 1254 may include a ratcheting feature (not illustrated) to interface with the barrel support 720 or forend 702 to allow fine adjustment/rotation of the tensioning mechanism 1250 or selective positioning of the tensioning mechanism 1250. Those skilled in the art will understand that a ratcheting feature is not the only solution; other solutions for selective positioning include, but are not limited to, detent mechanisms, interference fittings, gear mechanisms, levers, and/or other means known to those skilled in the art for controlling rotation of a mounted component.

Figure 23G:
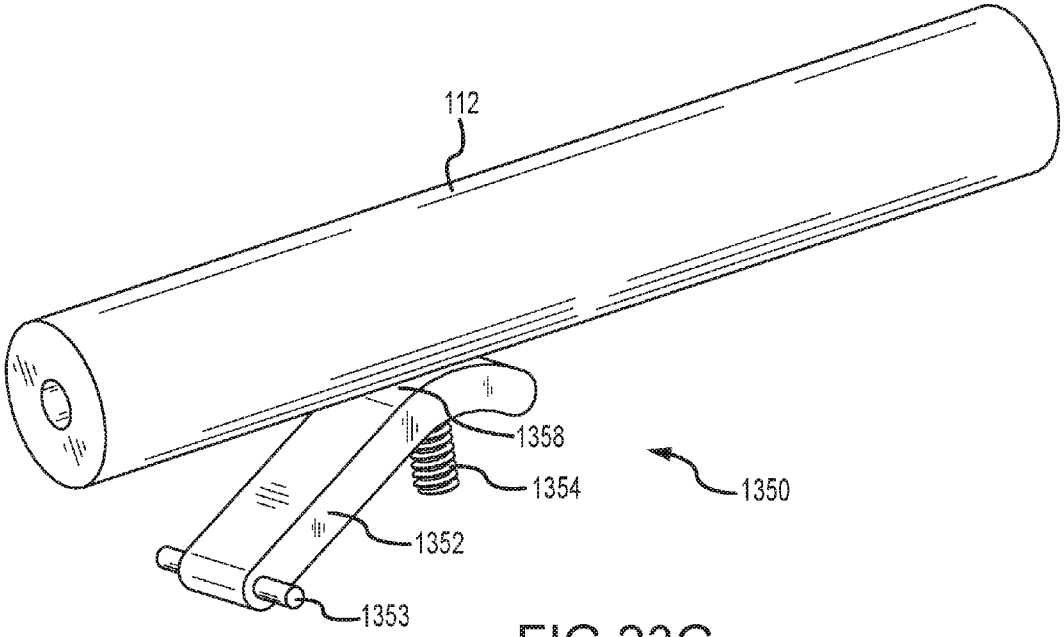
FIG. 23*g* is a perspective view illustrating features of another tensioning mechanism according to some embodiments.

As illustrated in FIG. 23*g*, in some embodiments, the tensioning mechanism 1350 may include a lever mechanism 1352 rotatingly mounted at a mounting point 1353 to the forend 702 and/or the barrel support 720, such that adjustment of the adjustment mechanism 1354 may cause different regions of a support surface 1358 to abut or engage the barrel 112. As in the embodiment illustrated in FIG. 23*f*, the tensioning mechanism 1350 illustrated in FIG. 23*g* may have a support surface 1358 and an adjustment mechanism 1354, such that manipulation of the adjustment mechanism 1354 may cause the tensioning mechanism 1350 and/or support surface 1358 to rotate about an axis that is transverse relative to the longitudinal axis of the barrel 112. The adjustment mechanism 1354 may include a threaded or cammed engagement with the barrel support 720 or the forend 702 to allow fine adjustment/rotation of the tensioning mechanism 1350 or selective positioning of the tensioning mechanism 1350. Those skilled in the art will understand that a screw or cam mechanism is not the only solution; other solutions for selective positioning include, but are not limited to, detent mechanisms, interference fittings, gear mechanisms, levers, and/or other means known to those skilled in the art for controlling rotation of a mounted component.

Figure 24:
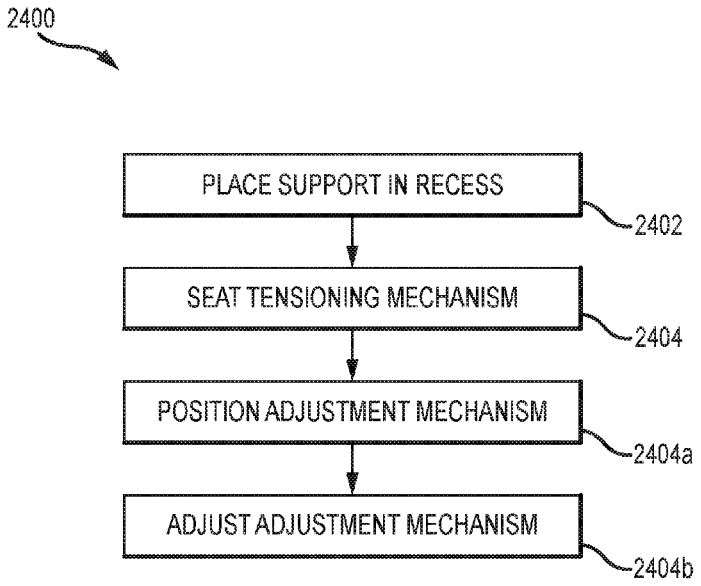
FIG. 24 is a flowchart of a method according to some embodiments.

Turning now to FIG. 24, in another example, a method 2400 of attaching a reversible barrel support to a firearm stock is provided. In this example, the method includes placing 2402 a reversible barrel support in a recess in a forend of a firearm stock, wherein the reversible barrel support has a first concave barrel recess facing upward. The method also includes seating 2404 a barrel tensioning mechanism in the first concave barrel recess, the barrel tensioning mechanism having a first support frame and an adjustment mechanism. Seating 2404 includes positioning 2404*a* the adjustment mechanism against the reversible barrel support, and adjusting 2404*b* the adjustment mechanism to control a seating position of the first support frame. Adjustment 2404*b* of the adjustment mechanism moves the seating position of the first support frame between a first position in which the first support frame is flush with or recessed in the first concave barrel recess and a second position in which the first support frame protrudes into the first concave barrel recess.

In some embodiments, adjustment 2404*b* is performed after assembling a firearm or a barrel of a firearm to the stock, and without disassembling the firearm or barrel from the stock. In some embodiments, adjustment 2404*b* is performed by inserting a tool into an aperture in the forend. Adjustment 2404*b* may be achieved using the embodiments illustrated in FIGS. 17-23G.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein. More specifically, disclosure of an act or method should be understood as a disclosure of a related device for carrying out the act or method; likewise, disclosure of a device for carrying out an act or method shall be understood as a disclosure of the act or method. For example, disclosure of a fastener shall be understood to include the act of fastening, and vice versa. Moreover, those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A firearm stock comprising:

a forend comprising a recess formed from first and second inner sides and an inside bottom of the forend;

a buttstock coupled to the forend;

a selectable barrel support seated in the recess in the forend and configured to support a barrel of a firearm, the selectable barrel support having an elongate frame with a longitudinal axis, a first concave barrel recess shaped to support a first barrel type and positioned on a first side of the elongate frame, and a second concave barrel recess shaped to support a second barrel type and positioned on a second side of the elongate frame; and a barrel tensioning mechanism having a first support frame and an adjustment mechanism; wherein the adjustment mechanism is configured to be positioned between the first support frame and the selectable barrel support; and wherein the first support frame has a first position and a second position and is configured to move between the first and second positions, wherein in the first position the first support frame is substantially flush with or recessed in the first concave barrel recess, and wherein in the second position the first support frame protrudes into the first concave barrel recess.

2. The firearm stock of claim 1, wherein the selectable barrel support has a longitudinal dimension such that the selectable barrel support, when engaged with the forend, is configured to extend from a receiver to a front end of the forend.

3. The firearm stock of claim 1, wherein the selectable barrel support is configured to support a free-floating barrel and to not contact the barrel of the firearm.

4. The firearm stock of claim 1, wherein the selectable barrel support is configured to contact and support the barrel of the firearm.

5. The firearm stock of claim 1, wherein the selectable barrel support is releasably held in the forend of the firearm stock.

6. The firearm stock of claim 1, configured to receive either a bull barrel or a barrel tapered toward a front of the barrel without requiring a change of the firearm stock.

7. The firearm stock of claim 1, wherein at least one of the first and second concave barrel recesses has a longitudinal dimension that is less than a longitudinal dimension of the selectable barrel support.

8. The firearm stock of claim 1, wherein the barrel tensioning mechanism further comprises a second support frame; wherein the second support frame has a first position and a second position and is configured to move between and including the first and second positions, wherein in the first position the second support frame is substantially flush with or recessed in the second concave barrel recess, and wherein in the second position the second support frame protrudes into the second concave barrel recess.

9. A barrel support system for a firearm stock, comprising:

a selectable barrel support for a firearm stock, the selectable barrel support having an elongate frame with a longitudinal axis, a first concave barrel recess shaped to support a first barrel type positioned on a first side of the elongate frame, and a second concave barrel recess shaped to support a second barrel type on a second side of the elongate frame; and a first barrel tensioning mechanism having a first support frame and an adjustment mechanism; wherein the adjustment mechanism is configured to be positioned between the first support frame and the selectable barrel support; and the first support frame has a first position and a second position and is configured to move between and including the first and second positions, wherein in the first position the first support frame is substantially flush with or recessed in the first concave barrel recess, and wherein in the second position the first support frame protrudes into the first concave barrel recess.

10. The barrel support system of claim 9, wherein the selectable barrel support has a longitudinal dimension that extends from proximal a front edge of the forend to proximal a front end of a receiver of the firearm.

11. The barrel support system of claim 9, wherein the selectable barrel support is configured to support a free-floating barrel and to not contact the firearm barrel.

12. The barrel support system of claim 9, wherein the selectable barrel support is configured to contact and support a barrel of the firearm.

13. The barrel support system of claim 9, configured to receive either a bull barrel or a barrel tapered toward a front of the barrel, without requiring a change of the firearm stock.

14. The barrel support system of claim 9, wherein at least one of the first and second concave barrel recesses has a longitudinal dimension that is less than a longitudinal dimension of the selectable barrel support.

15. The barrel support system of claim 9, wherein the first barrel type is a bull barrel and the second barrel type is a tapered barrel.

16. The barrel support system of claim 9, where the radii at the fore and aft portions of the first concave barrel recess are equal, and the radii at the fore and aft portions of the second concave barrel recess are not equal.

17. The barrel support system of claim 9, wherein the barrel tensioning mechanism further comprises a second support frame; wherein the second support frame has a first position and a second position and is configured to move between and including the first and second positions, wherein in the first position the second support frame is substantially flush with or recessed in the second concave barrel recess, and wherein in the second position the second support frame protrudes into the second concave barrel recess.

18. A selectable barrel support kit, comprising:

a selectable barrel support for a firearm stock, the selectable barrel support having an elongate frame with a longitudinal axis, a first concave barrel recess shaped to support a first barrel type positioned on a first side of the elongate frame, and a second concave barrel recess shaped to support a second barrel type on a second side of the elongate frame; and a barrel tensioning mechanism having a first support frame, a second support frame, and an adjustment mechanism configured to adjust a seating position of at least one of the first support frame or the second support frame; wherein the seating position is adjustable between a first position in which the at least one of the first support frame or the second support frame is flush with or recessed in the selectable barrel support, and a second position in which the at least one of the first support frame or the second support frame protrudes from the selectable barrel support.

19. The selectable barrel support kit of claim 18, wherein:

the first support frame is unitary with or coupled to the second support frame.

20. The selectable barrel support kit of claim 18, wherein:

the first support frame is configured to protrude from the first concave recess when the first support frame is in the second position; and the second support frame is configured to protrude from the second concave recess when the second support frame is in the second position.

* * * * *